US012630951B2

(12) United States Patent
Lonati et al.

(10) Patent No.: US 12,630,951 B2
(45) Date of Patent: May 19, 2026

(54) CIRCULAR KNITTING MACHINE FOR HOSIERY OR THE LIKE AND METHOD FOR PROVIDING A TUBULAR ITEM

(71) Applicant: Lonati S.P.A., Brescia (IT)

(72) Inventors: Ettore Lonati, Botticino (IT); Fausto Lonati, Brescia (IT); Francesco Lonati, San Felice del Benaco (IT)

(73) Assignee: Lonati S.P.A., Brescia (IT)

( * ) Notice: Subject to any disclaimer, the term of this patent is extended or adjusted under 35 U.S.C. 154(b) by 0 days.

(21) Appl. No.: 18/689,924

(22) PCT Filed: Aug. 23, 2022

(86) PCT No.: PCT/EP2022/073401
§ 371 (c)(1),
(2) Date: Mar. 7, 2024

(87) PCT Pub. No.: WO2023/036598
PCT Pub. Date: Mar. 16, 2023

(65) Prior Publication Data

US 2024/0240373 A1 Jul. 18, 2024

(30) Foreign Application Priority Data

Sep. 9, 2021 (IT) ..... 102021000023264

(51) Int. Cl.
*D04B 9/40* (2006.01)
*D04B 9/46* (2006.01)

(52) U.S. Cl.
CPC ..... *D04B 9/40* (2013.01); *D04B 9/46* (2013.01)

(58) Field of Classification Search
CPC ..... D04B 9/40; D04B 9/42; D04B 9/44; D04B 9/46; D04B 9/48; D04B 9/50; D04B 15/02
(Continued)

(56) References Cited

U.S. PATENT DOCUMENTS 5,487,281 A * 1/1996 Frullini ..... D04B 15/02 66/13
6,164,091 A * 12/2000 Frullini ..... D04B 9/40 66/58
6,389,849 B1 * 5/2002 Conti ..... D04B 15/92 66/148
(Continued)

FOREIGN PATENT DOCUMENTS

CN 101970739 A 2/2011
EP 2250307 B1 10/2011
WO WO-2019197928 A1 * 10/2019 ..... D04B 9/40
WO WO-2020255052 A1 * 12/2020 ..... D04B 15/02

OTHER PUBLICATIONS

Search Report mailed Apr. 28, 2022 in Italian Appl. 102021000023264 (12 pgs.).
(Continued)

*Primary Examiner* — Aiying Zhao
(74) *Attorney, Agent, or Firm* — Quicker Law, LLC

(57) ABSTRACT

A circular knitting machine for hosiery, comprising at least one needle cylinder configured to provide a tubular item, and a pickup device which is adapted to pass between a pickup position and a release position at a further processing station, a turning device being provided which comprises a lower portion designed to accommodate coaxially the tubular item, wherein the circular machine comprises a lifting element which is adapted to pass between an inactive condition, in which it is arranged externally with respect to the region affected by the movement of the pickup device and of the corresponding tubular item and an active position, in which the lifting element is adapted to interact with at least one portion of the tubular item.

3 Claims, 24 Drawing Sheets

(58) Field of Classification Search
USPC ..... 66/58, 59, 148
See application file for complete search history.

(56) References Cited

U.S. PATENT DOCUMENTS

| | | | | |
|---|---|---|---|---|
| 2002/0000106 | A1 | 1/2002 | Sangiacomo | |
| 2010/0313607 | A1* | 12/2010 | Lonati | D04B 9/02 66/148 |
| 2010/0313608 | A1* | 12/2010 | Lonati | D06G 3/04 223/43 |
| 2016/0024695 | A1* | 1/2016 | Conti | D04B 9/40 66/58 |
| 2020/0308759 | A1* | 10/2020 | Bottini | D04B 15/02 |
| 2024/0263368 | A1 | 8/2024 | Lonati et al. | |

OTHER PUBLICATIONS

International Search Report and Written Opinion mailed Nov. 8, 2022 in PCT/EP2022/073401 (13 pgs.).
Office Action mailed Jun. 7, 2023 in related Pakistan Application No. 577/2022 (2 pgs.).
English-language translation of Office Action mailed Apr. 26, 2024 in Eurasian application No. 580791EA (4 pgs.).
Office Action mailed Sep. 16, 2025 in Chinese application No. 202280059841.2 with English-language translation (17 pgs.).
Office Action mailed Dec. 30, 2025 in Egyptian application No. EG/P/2024/00316 with English-language translation (10 pgs.).
Office Action mailed Mar. 5, 2026 in Chinese application No. 202280059841.2 with English-language translation (17 pgs.).

* cited by examiner

CIRCULAR KNITTING MACHINE FOR HOSIERY OR THE LIKE AND METHOD FOR PROVIDING A TUBULAR ITEM

CROSS-REFERENCE TO RELATED APPLICATIONS

This application is the National Stage of International Application No. PCT/EP2022/073401 filed Aug. 23, 2022, which claims priority to and the benefit of Italian Application No. 102021000023264 filed Sep. 9, 2021, the disclosures of both of which are incorporated herein by this reference in their entireties.

FIELD OF THE INVENTION

The present invention relates to a circular knitting machine for hosiery or the like and a method for providing a tubular item.

BACKGROUND OF THE INVENTION

In the sector of production of knitted tubular items with circular knitting machines for hosiery or the like, in some cases there is the need to perform a transfer of the item from the machine used for the production of the item to another production unit in order to perform further work on the item that cannot be performed on such machine or which it is not economically convenient to perform on such machine.

In particular, in the sector of production of hosiery items, in recent years, techniques for automatically closing the toe thereof, by sewing or linking, have been developed. Some of these techniques are based on the removal of the item from the machine used for its production and on its transfer to a station for further processing, separate from the production machine, so as to close the toe of the hosiery item in the station for further processing while the machine is used to produce another hosiery item. These techniques have the advantage, with respect to other techniques that are based on closing the toe of the hosiery item directly on the machine used for its production, of not excessively penalizing the productivity of the machine.

The transfer of the hosiery item, or more generally of the tubular item, from the machine used for its production to the station at which the closing of an axial end of the item, or more generally further processing on the item, must be performed is generally performed by means of a pickup device which, using pickup elements, individually picks up the loops of knitting of the item from the needles of the machine and holds them during the transfer of the item.

In some techniques for closing the toe of hosiery items, the pickup device is also used to support the item during the execution of the further processing, while in other techniques the pickup device is used only to transfer the item since, once it has arrived at the station in which the further processing is to be performed, it releases, usually again individually, the loops of knitting, which were previously removed from the needles, to another device whose function is to support the item during the execution of the further processing, such as for example a handling device.

In both techniques, the sewing or linking operation is very often carried out on the item in the inside-out configuration so that the sewing or linking chain is not easily visible on the external side of the item and that is to say on the side that, usually, is visible with the article being worn.

For this reason, in sewing or linking stations intended to implement these techniques for closing one axial end of knitted tubular items, a turning device is generally provided the function of which is to perform the inversion of the item, which is taken in the right-way-out configuration from the machine that produced it, before subjecting it to the sewing or linking operation and optionally inverting it again in order to bring it to the right-way-out configuration after the sewing or linking operation.

One of the most widespread types of turning devices for this type of use is based on using a tubular body which, from below, faces the item, which is held by a pickup device or by a handling device at its axial end to be closed and is arranged substantially vertically with such axial end directed upward. The tubular body is also arranged with its axis vertical, so as to face the hung item with its upper axial end. The inside of the tubular body is therefore connected to suction means so as to suck, through its upper axial end, the item which however remains retained, at its axial end to be closed, by the pickup device or by the handling device. The tubular body is then lifted so that its upper axial end passes through the axial end of the item which is engaged with the pickup device or with the handling device. As a consequence of this passing through, the item is everted on the outer lateral surface of the tubular body and is extracted progressively from the upper axial end of the tubular body by carrying out its turning.

For tubular items of considerable weight, such as for example for hosiery items of great thickness and/or considerable weight, difficulties can be encountered in successfully ensuring a correct insertion of the tubular item inside the tubular body.

BRIEF SUMMARY OF THE INVENTION

The aim of the present invention is to solve the above mentioned problems, by providing a circular knitting machine for hosiery or the like, that ensures the correct insertion of the tubular item, even of considerable weight and length, inside the tubular body.

Another object of the invention is to provide a circular knitting machine for hosiery or the like that offers high reliability and precision of operation.

A further object of the invention is to provide a circular knitting machine for hosiery or the like that is structurally simple and that can be produced at low cost.

This aim and these and other objects which will become better apparent hereinafter are achieved by a circular knitting machine for hosiery or the like and by a method for providing a tubular item according to the independent claims, optionally provided with one or more characteristics of the dependent claims.

BRIEF DESCRIPTION OF THE DRAWINGS

Further characteristics and advantages of the invention will become better apparent from the detailed description that follows of a preferred, but not exclusive, embodiment of the circular knitting machine for hosiery or the like, according to the invention, which is illustrated for the purposes of non-limiting example in the accompanying drawings wherein.

DETAILED DESCRIPTION OF THE INVENTION

Figure 1:
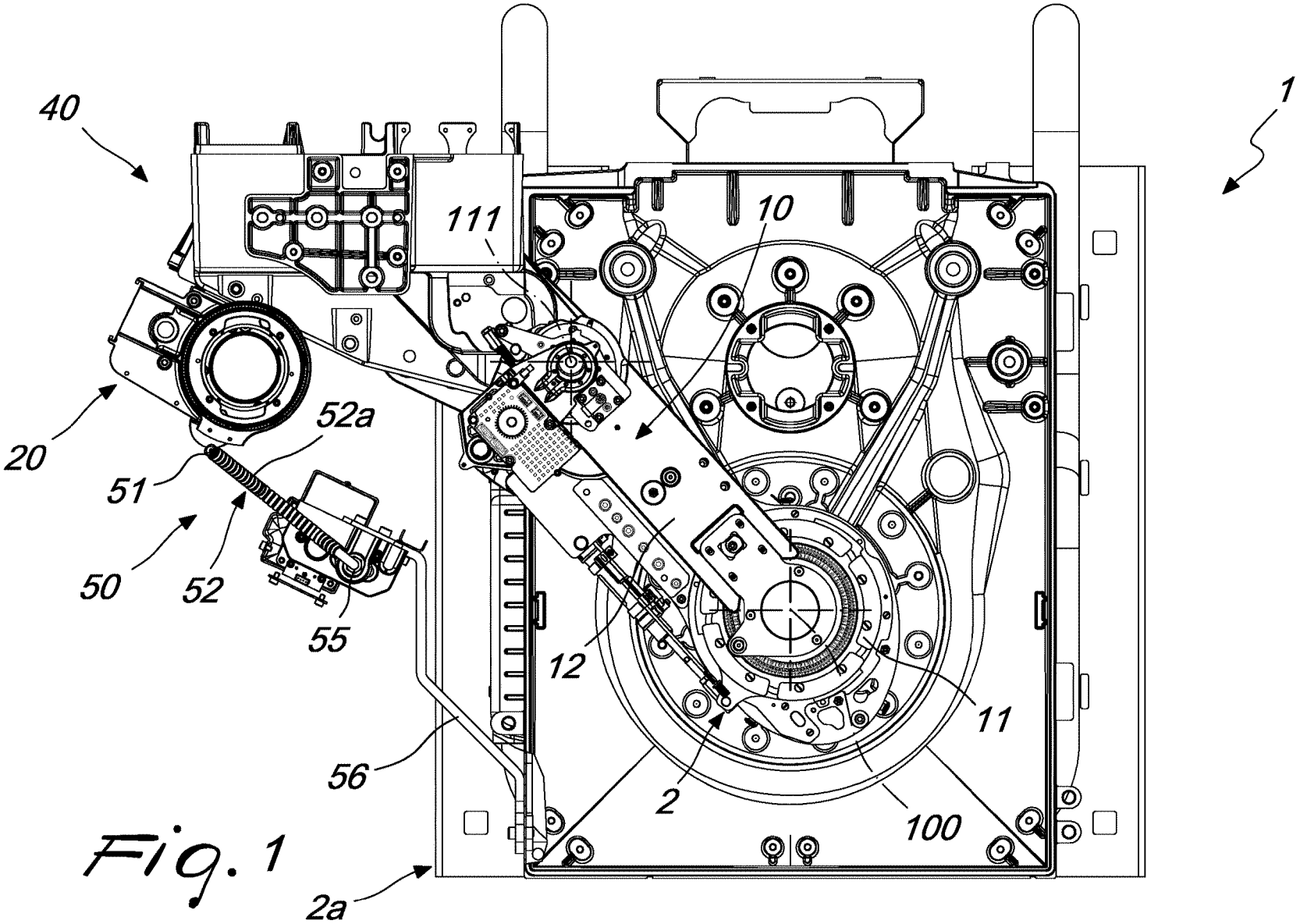
FIG. 1 is a view from above of the machine according to the invention wherein the lifting device is in the inactive condition, the pickup device is in the pickup position, and the lower portion of the pickup device is in the first position.

With reference to the figures, the circular knitting machine for hosiery or the like according to the invention, generally designated by the reference numeral 1, comprises at least one needle cylinder 2 which has a cylinder axis 100 and is configured to provide a tubular item 101.

The circular machine 1 can be a single-cylinder circular machine or a double-cylinder machine for knitting or for hosiery.

The needles are actuated in a way that is per se known, for example using cams, not shown for the sake of simplicity, which are arranged about needle cylinder or cylinders and which can be engaged, as a consequence of the rotation of the needle cylinders about their axis with respect to these cams, with the heels of the needles that protrude radially from the lateral surface of the needle cylinders. Since it is a substantially conventional machine, the circular machine 1 is not described further for the sake of simplicity.

The circular machine 1 comprises a pickup device 10 which is adapted to pass between a pickup position, in which it is positioned coaxially around the needle cylinder or cylinders 2, in order to pick up the tubular item 101 at a first axial end thereof 101*a* from the needle cylinder 2, and a position for the release of the tubular item 101 at a station for further processing 40 of the tubular item 101, which is laterally spaced apart from the needle cylinder 2.

Preferably, the station for further processing 40 comprises a linking or sewing station.

By way of example, the pickup device 10 comprises a pickup body 11, annular in shape, pickup elements which can slide, with respect to the removal body 11, along radial directions. The pickup body 11 can be arranged coaxially around the needle cylinder 2 with each one of the pickup elements laterally facing a corresponding needle of the circular machine 1.

The pickup device 10 comprises actuation means that act on the pickup elements in order to actuate their movement toward or away from the axis of the pickup body so as to actuate the engagement or the disengagement of each pickup element with the needle that it is facing, and each one of the pickup elements is adapted to pick up the loop of knitting of the item 101 that is held on the needle.

Obviously, there is no reason why the pickup elements cannot be engaged between the loops of knitting if a non-linked sewing operation is to be performed subsequently.

More specifically, the pickup body 11 is arranged with its axis arranged vertically and is fixed to the end of an arm, arranged horizontally, which is connected, with its opposite end, to a sleeve with a vertical axis 102. The sleeve is fitted coaxially around a hollow shaft and is integral with this in rotation about its own axis. The hollow shaft is supported, rotatably about its own axis 102, by a supporting structure which can be constituted by the same supporting structure 2*a* as the machine 1 or by an independent supporting structure which can optionally be associated with the supporting structure 2*a* of the machine 1.

Preferably, it is possible to stop the rotation of the arm in at least one standby position or intermediate position located between the above-mentioned pickup position and release position.

The two or three or more positions, which can be assumed by the pickup body 11 as a result of the actuation of drive means, for example constituted by an electric motor, are controlled by respective sensors which detect markers placed on the respective parts in mutual movement.

The pickup body 11 is likewise associated with a conventional knitting-pusher arm 12.

The circular machine 1 is provided, at the further processing station 40, with a turning device 20 which comprises a lower portion 22 which defines in an upper region an access mouth 21.

The lower portion 22 of the turning device 20 extends about a respective axis of extension 103 and is designed to accommodate coaxially the tubular item 101 in order to perform its turning.

Advantageously, the turning device 20 also comprises, in addition to the lower portion 22, an upper portion 25, which are arranged respectively below and above an intermediate region at which means 41 for supporting the tubular item 101 to be turned, which hangs at the first axial end 101*a*, are or can be positioned.

The lower portion 22 of the turning device 20 is movable between a first position (illustrated in FIGS. 1 to 6 and FIGS. 17 to 24), in which the access mouth 21 is aligned with the upper portion 25 of the turning device 20 in order to allow the turning of the tubular item 101, and a second position (shown in FIGS. 7 to 16), in which the access mouth 21 is arranged laterally with respect to the upper portion 25 in order to allow the transfer of the tubular item 101 from the needle cylinder 2 into the lower portion 22.

According to the present invention, the machine 1 comprises a lifting element 50, which is adapted to pass between an inactive condition (shown in FIGS. 1 to 2, and FIGS. 14 to 24) in which it is arranged externally with respect to the region affected by the movement of the pickup device 10 and of the corresponding tubular item 101 associated therewith during the transition of the lower portion 22 from the second position to the first position, and an active position (shown in FIGS. 3 to 13) in which the lifting element 50 is adapted to interact with at least one portion of the tubular item 101.

In particular, in the active position the lifting element 50 is movable, on command, along a lifting trajectory 200 in order to engage with a portion of the tubular item 101 so as to determine the disengagement of the second axial end 101*b* of the tubular item 101, opposite to the first axial end 101*a*, from the needle cylinder 2 and the conveyance of the second axial end 101*b* of the tubular item substantially to the access mouth 21 when the lower portion 22 is in the second position.

Conveniently, the turning device 20 is associated with suction means adapted to transfer the tubular item 101 conveyed to the access mouth 21 into the lower portion 22 of the turning device 20.

Advantageously, the lifting trajectory 200 has a substantially vertical extension.

In greater details, the lifting element 50 is adapted to engage the tubular item 101 at an intermediate portion between the first axial end 101*a* and the second axial end 101*b*.

Preferably, the lifting element 50 comprises a U-shaped engagement body 51.

The engagement body 51 is supported at a lateral end thereof, by a supporting rod 55 which is kinematically connected to command means that are adapted to result in its transition from the inactive condition to the active condition and vice versa, and its movement along the lifting trajectory 200.

The supporting rod 55 can be fixed, for example by way of fixing means that are per se known, to the supporting structure 2*a*, but there is no reason why the supporting rod cannot be integral with an independent structure that is separate from the machine 1.

It can be seen in fact that the lifting element 50 according to the invention can be associated with any machine 1 simply by programming the movement as a function of the movement of that machine.

The command means comprise drive means, optionally associated with a control system for governing its movement (in terms both of time and of trajectory).

With reference to the embodiment shown in the figures, the lifting element 50 comprises at least one contact element 52 which is designed to make contact with the tubular item 101 and is adapted to reduce the sliding friction between the lifting element 50 and the tubular item 101.

In fact during the lifting and lowering of the lifting element 50 a sliding occurs between the lifting element 50, for example at the engagement body 51, and the outward-facing surface of the tubular item 101.

By way of example, the contact element 52 comprises a plurality of annular bodies 52*a* which are coupled rotatably to and fitted around the engagement body 51.

Figures 22, 22A:
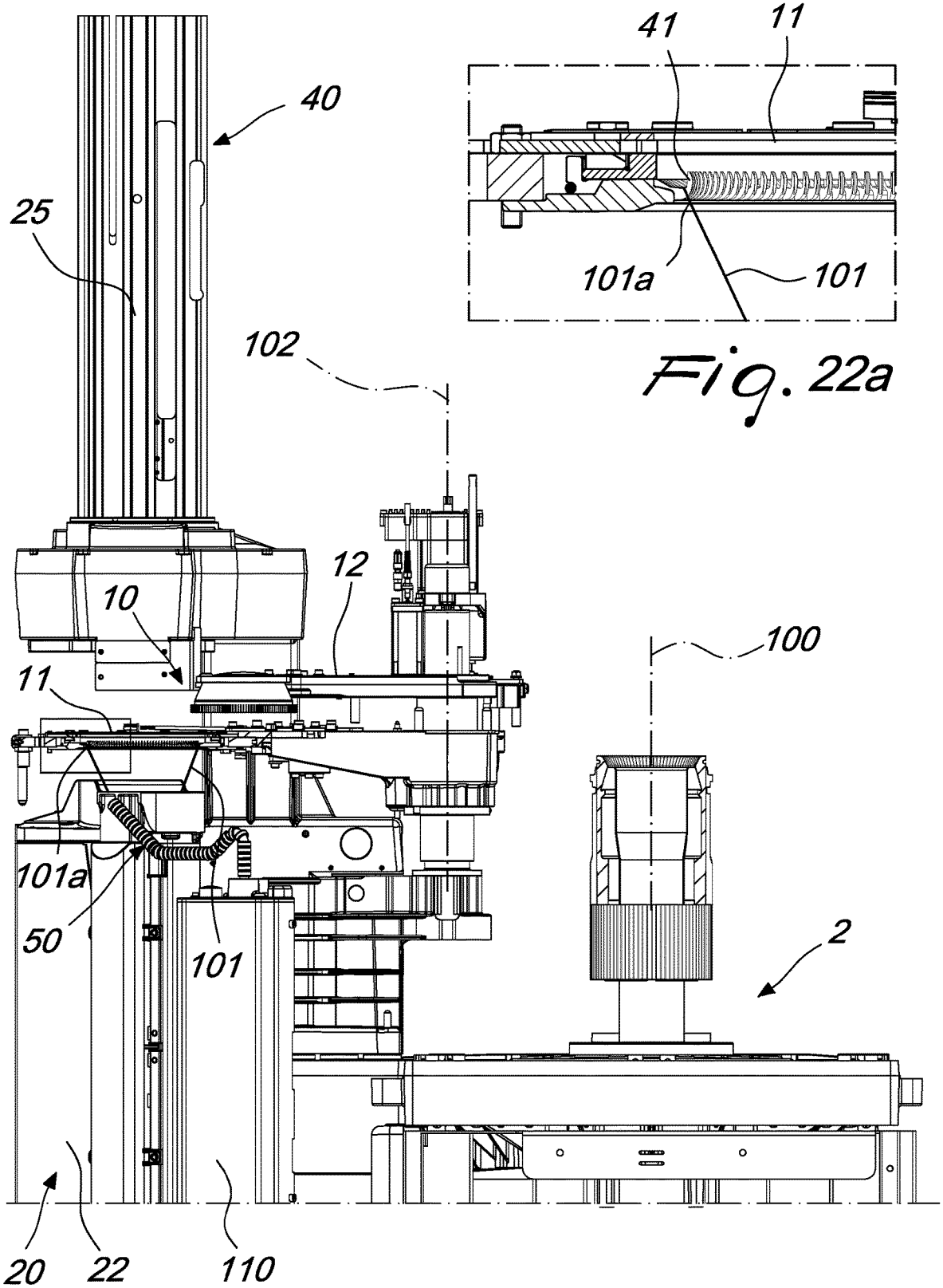
FIG. 22 is a view similar to FIG. 21 in which the pickup body has been brought to the release position.
FIG. 22*a* is an enlarged view of a portion of the pickup body.
Figure 23:
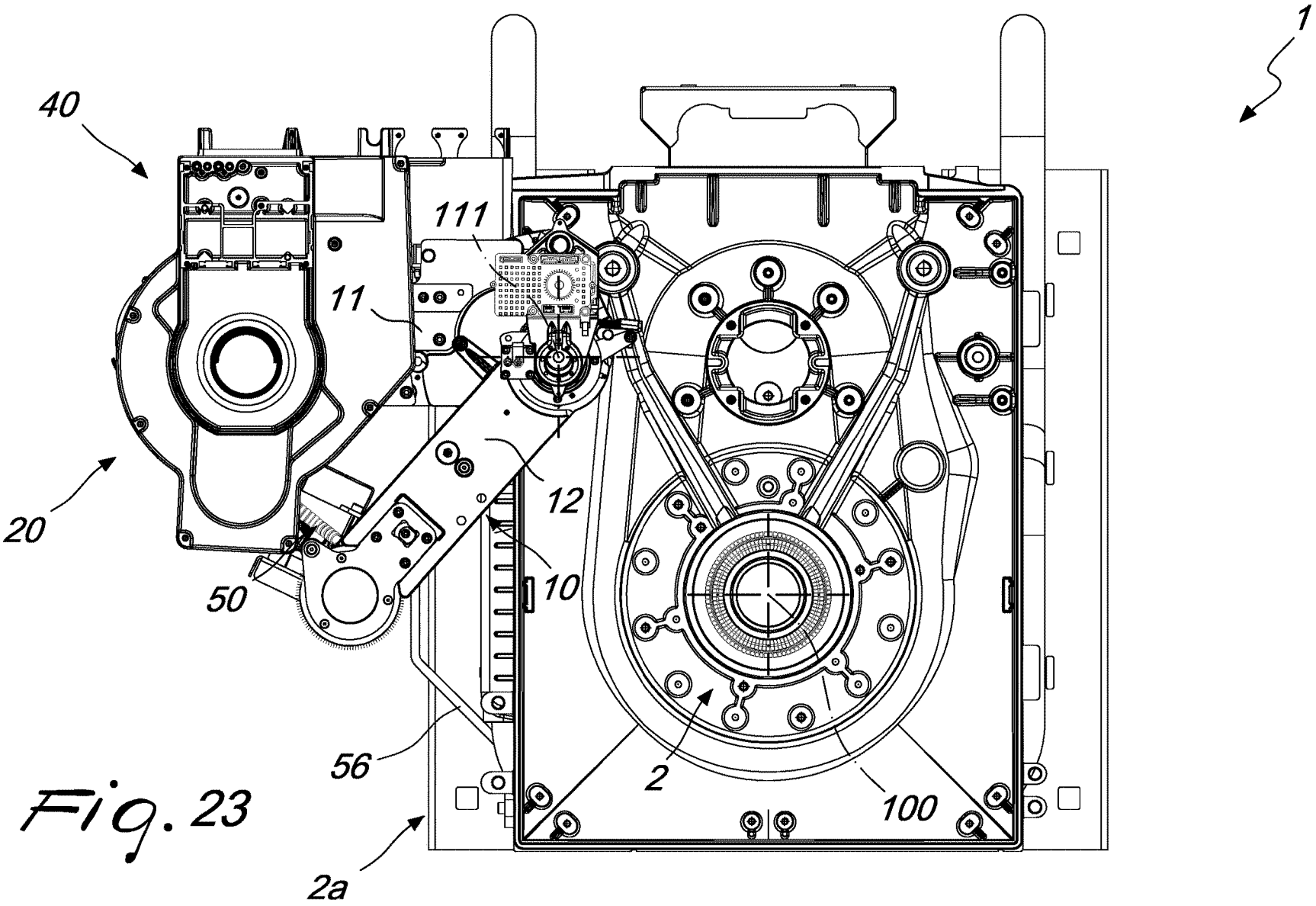
FIG. 23 is a view from above of the machine in the condition of FIG. 22.

In order to perform the turning of the tubular item, as shown in FIG. 22 and as substantially known, the turning device 20 comprises a tubular body 23 which can be inserted from below toward the upper part of the lower portion 21, with its upper axial end, through the axial end of the tubular item 101 which hangs from the supporting means 41 after suction of the tubular item 101 through the upper axial end of the tubular body 23, for the eversion of the item, retained by the supporting means 41.

With reference to the embodiment shown in the figures, the lower portion 22 of the turning device 20 can be inclined on command about a pivoting axis 110 in order to pass from the first position to the second position and vice versa.

The tubular body 23 can, furthermore, move on command when the lower portion 22 is in the second position, in order to pass from a retracted position (shown in FIG. 7) in which it is accommodated within the lower portion 22, to an extended position (illustrated for example in FIG. 8) in which it protrudes from the access mouth 21 in order to be moved below the second end portion 101*b* of the tubular item 101 lifted by the lifting element 50.

The present invention further relates to a method for providing a tubular item comprising the steps of:

- producing, using at least one needle cylinder 2, a tubular item 101;
- picking up, using a pickup device 10, the tubular item 101 at a first axial end 101*a;*
- moving a lifting element 50 from an inactive position to an active position;
- transferring the first axial end 101*a* of the tubular item 101 from a pickup position, at the needle cylinder 2, to a release position at a further processing station 40 of the tubular item 101;
- lifting the lifting element 50 to the active position along a lifting trajectory 200 in order to engage with a portion of the tubular item 101 so as to determine the disengagement of the second axial end 101*b* of the tubular item 101, opposite to the first axial end 101*a*, from the needle cylinder 2;
- moving a lower portion 22 of a turning device 20 which has an access mouth 21 between a first position, in which the access mouth 21 is aligned with an upper portion 25 of the turning device 20, and a second position, in which the access mouth 21 is arranged laterally with respect to the upper portion 25 and substantially below the second axial end 101*b* of the tubular item 101;
- aspirating, using suction means, the tubular item 101 in order to transfer it, through the access mouth 21, to the lower portion 22 of the turning device 20;
- moving the lifting element 50 from the active position to the inactive position;

moving the lower portion 22 from the second position to the first position.

In particular, the step of transferring the first axial end 101*a* of the tubular item 101 from a pickup position, at the needle cylinder 2, to a release position, can also be completed upstream of the above mentioned station for further processing 40 of the tubular item 101: the important thing is that at the end of the above mentioned step of transfer, the necessary space is created for the lifting element 50 to be moved.

Advantageously, the method entails, after the step of moving the lower portion 22 from the second position to the first position, a step of turning the tubular item 101 using the turning device 20.

There can be various operations to bring the tubular item to the turning device 20.

Conveniently, the method comprises, between the step of moving the lower portion 22 between the first position and the second position, and the step of aspirating, at least one further step of lifting the lifting element 50 along the lifting trajectory 200.

The lifting step comprises a first step of raising the lifting element 50 and a second step of lowering the lifting element 50.

Now, with reference to the accompanying figures, the method of the machine according to the invention will be described in greater detail.

Figure 2:
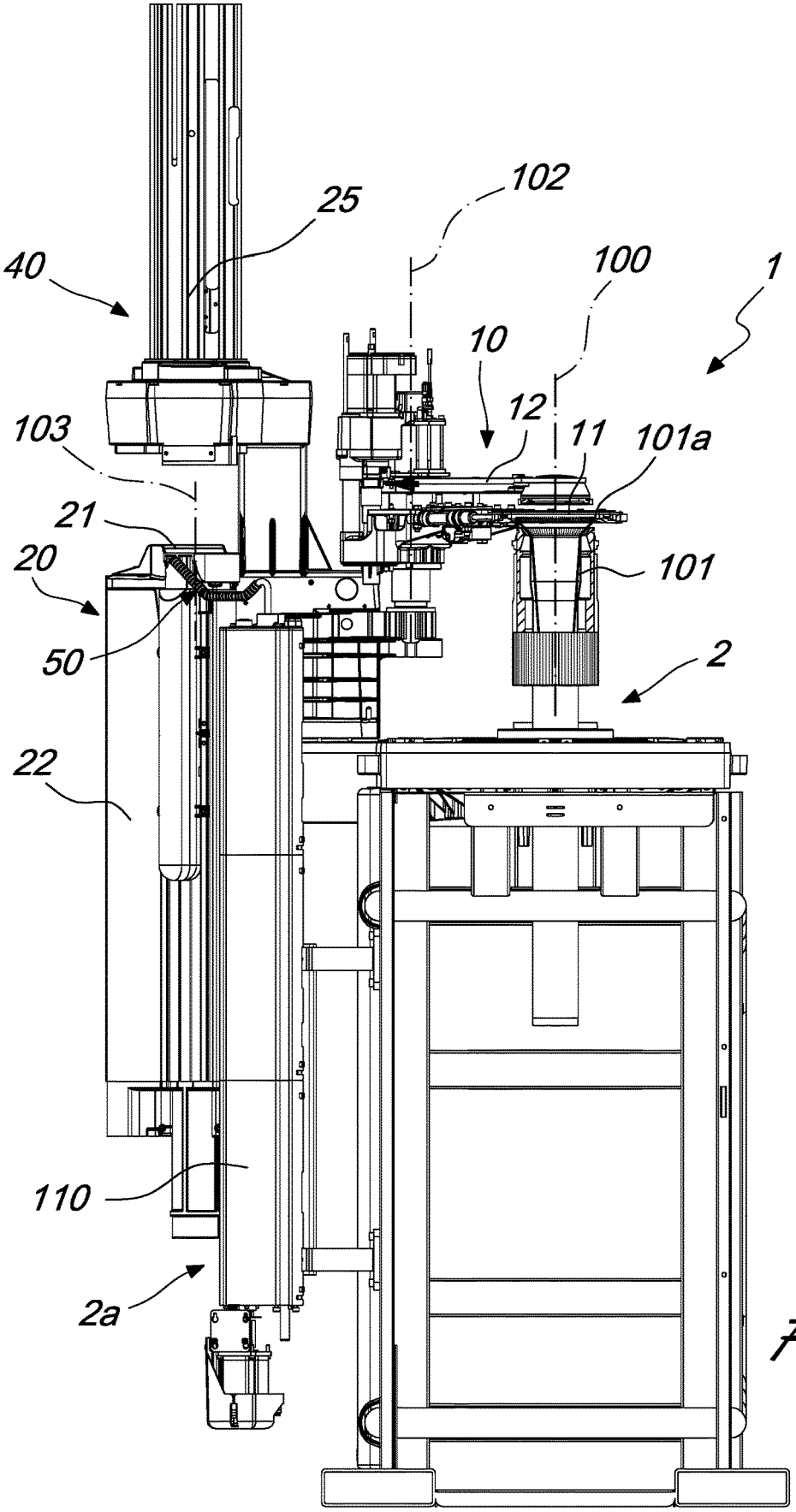
FIG. 2 is a front elevation view of the machine shown in FIG. 1.

FIG. 1 and FIG. 2 show the machine 1 once the needle cylinder 2 has completed the production of the tubular item 101.

The pickup device 10 is therefore brought to the pickup position, in which it is positioned coaxially around the needle cylinder or cylinders 2, in order to pick up the tubular item 101 at a first axial end thereof 101*a* from the needle cylinder 2.

The lower portion 22 of the turning device 20 is now in the first position, while the lifting element 50 is in the inactive condition.

Figure 3:
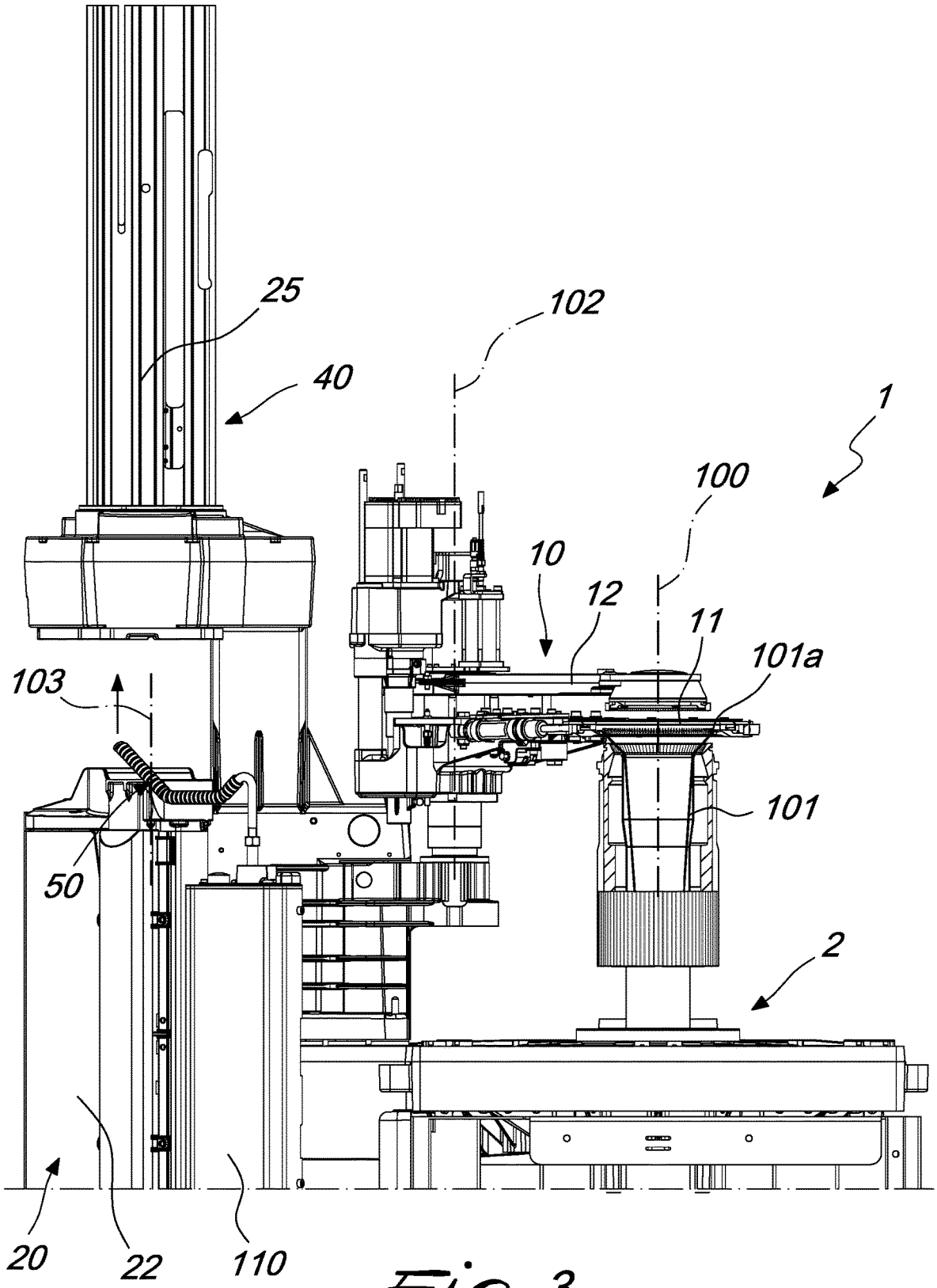
FIG. 3 is a view similar to the previous view with the lifting device in the intermediate condition between the inactive condition and the active condition.
Figure 4:
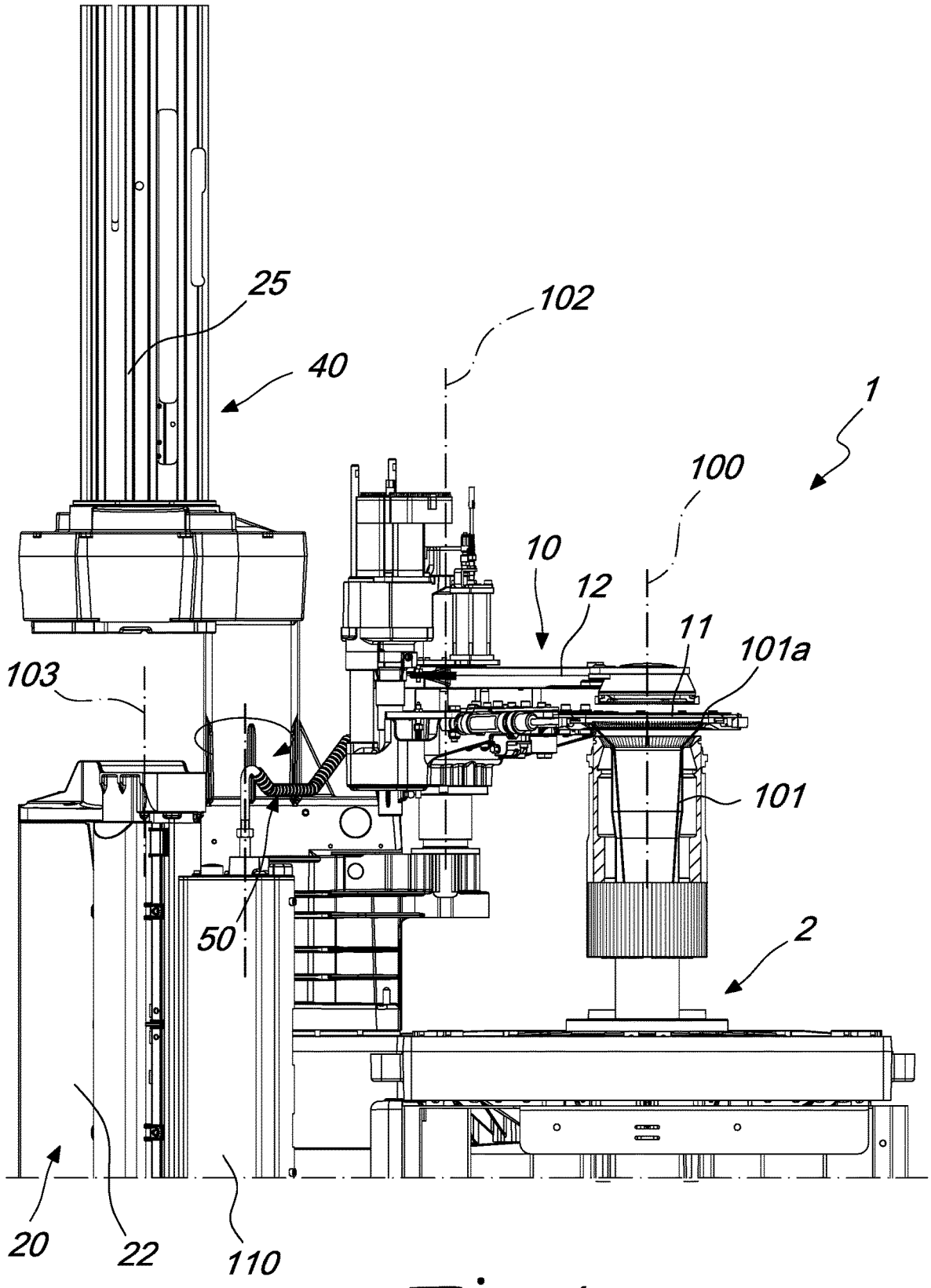
FIG. 4 is a view similar to that of FIG. 3 in which the lifting device is in the active condition.

At this point, as shown in FIGS. 3 and 4, the lifting element 50 is moved from the inactive condition to the active condition.

This movement can be carried out using drive means that act on the supporting rod 55, and which are adapted to make the lifting element 50 rotate about a rotation axis substantially parallel to the extension of the supporting rod 55.

Figure 5:
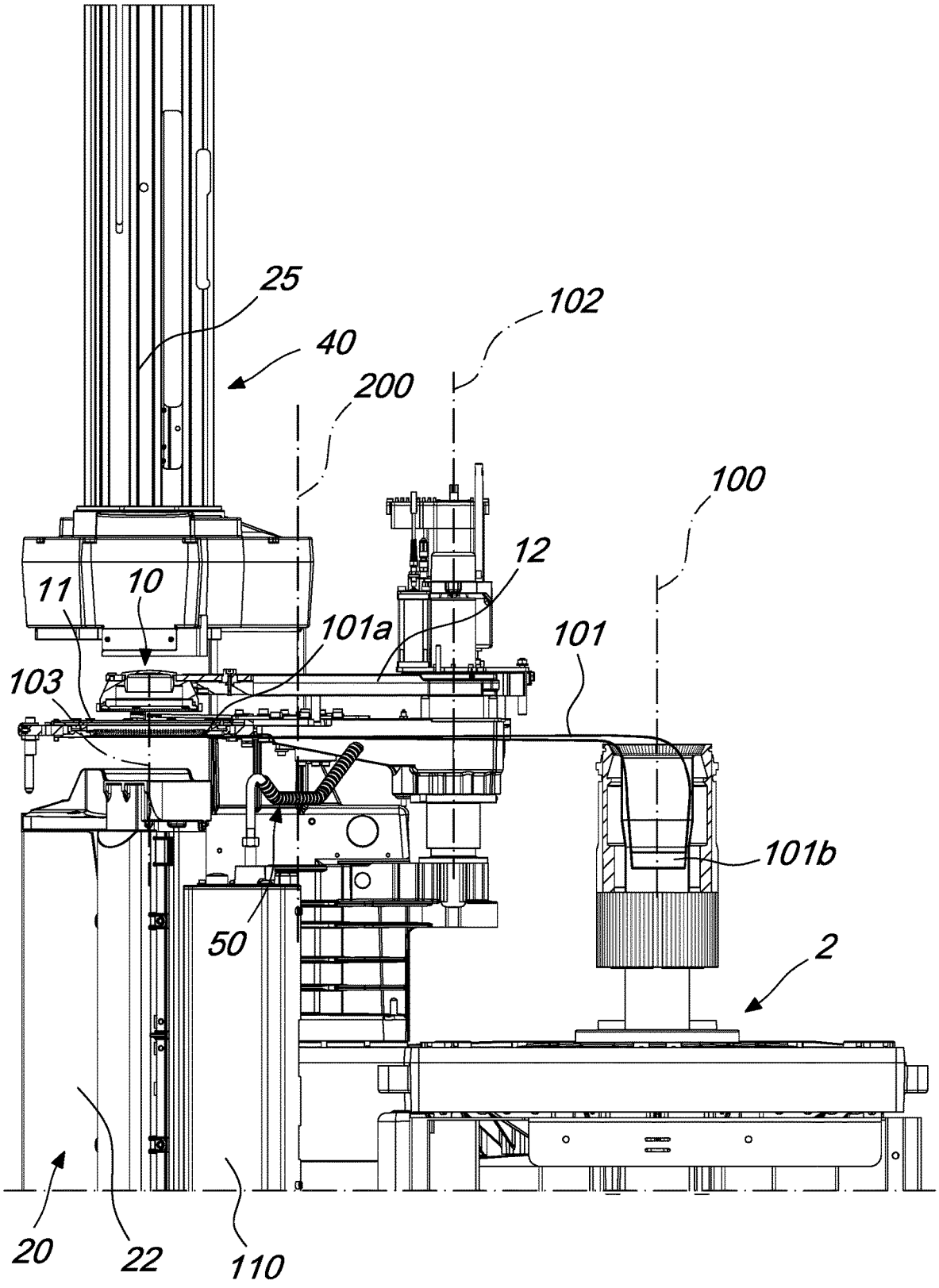
FIG. 5 is a view similar to the previous views in which the pickup device is arranged at the station for further processing.
Figure 6:
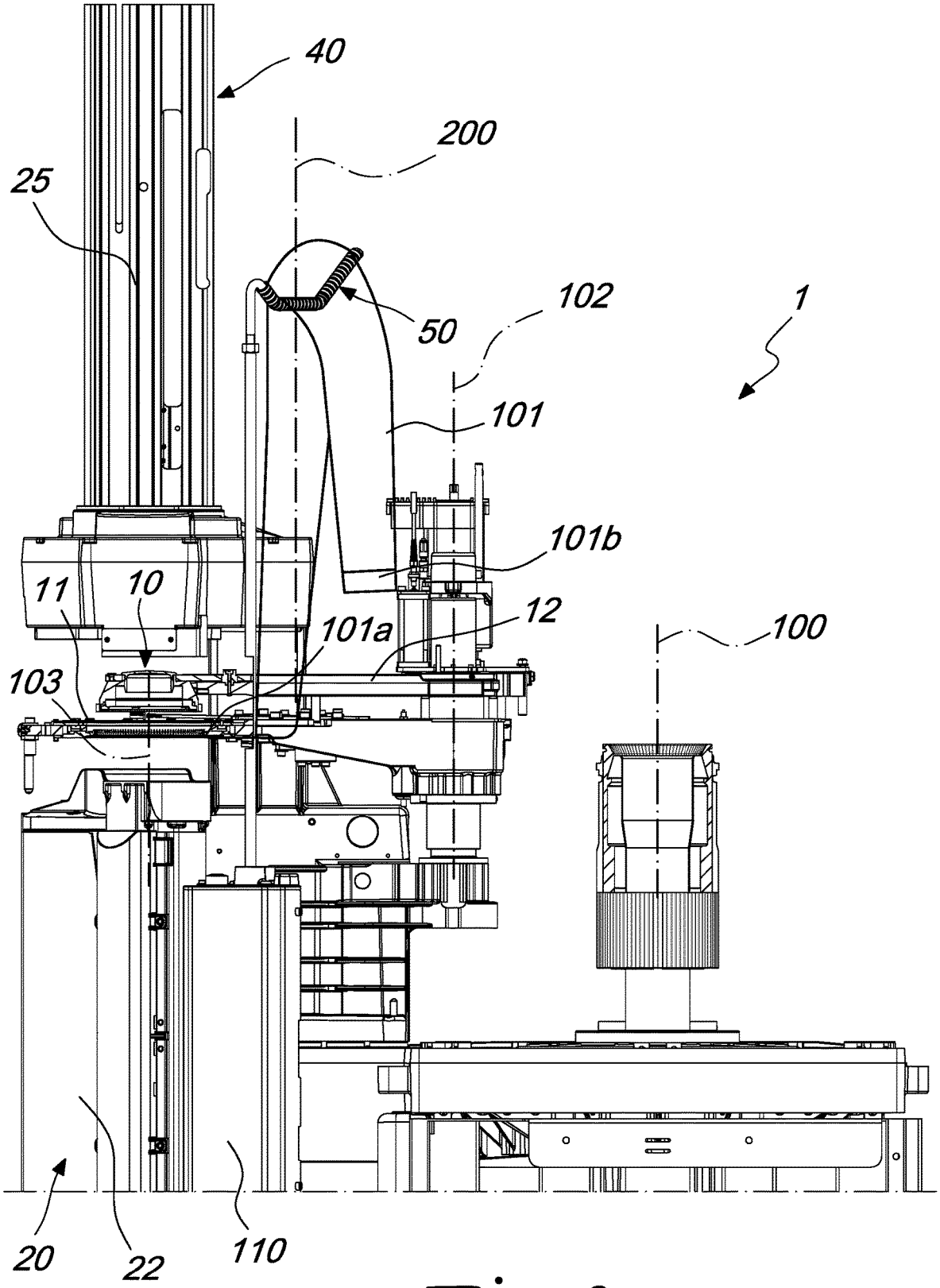
FIG. 6 is a view similar to FIG. 5 during the step of lifting the lifting element.

As shown in FIG. 5, once the lifting element 50 is brought to the active condition, the pickup device is brought from the pickup position to the release position.

As explained previously, for reasons of convenience, as shown in the figures, the pickup device 10 has been indicated and illustrated in the release position but, however, it is possible for such pickup device to be maintained in a position upstream of the pickup position which still allows the lifting element 50 to engage with the portion of the tubular item 101.

In such situation, it seems evident that the tubular item 101 extends between the needle cylinder 2, where the second axial end 101*b* is still positioned, and the further processing station 40, where the pickup device 10 that supports the first axial end 101*a* is positioned.

The lifting element 50 in its active position is arranged below an (intermediate) portion of the tubular item 101 and is in a completely lowered position so as to not interfere with the tubular item 101 during the transition of the pickup device 10 from the pickup position to the release position.

At this point, the lifting element 50 (FIG. 6) is moved along the direction of lifting 200, ending up engaging with a portion of the tubular item 101 so as to disengage the second axial end 101*b* from the needle cylinder 2.

Figure 7:
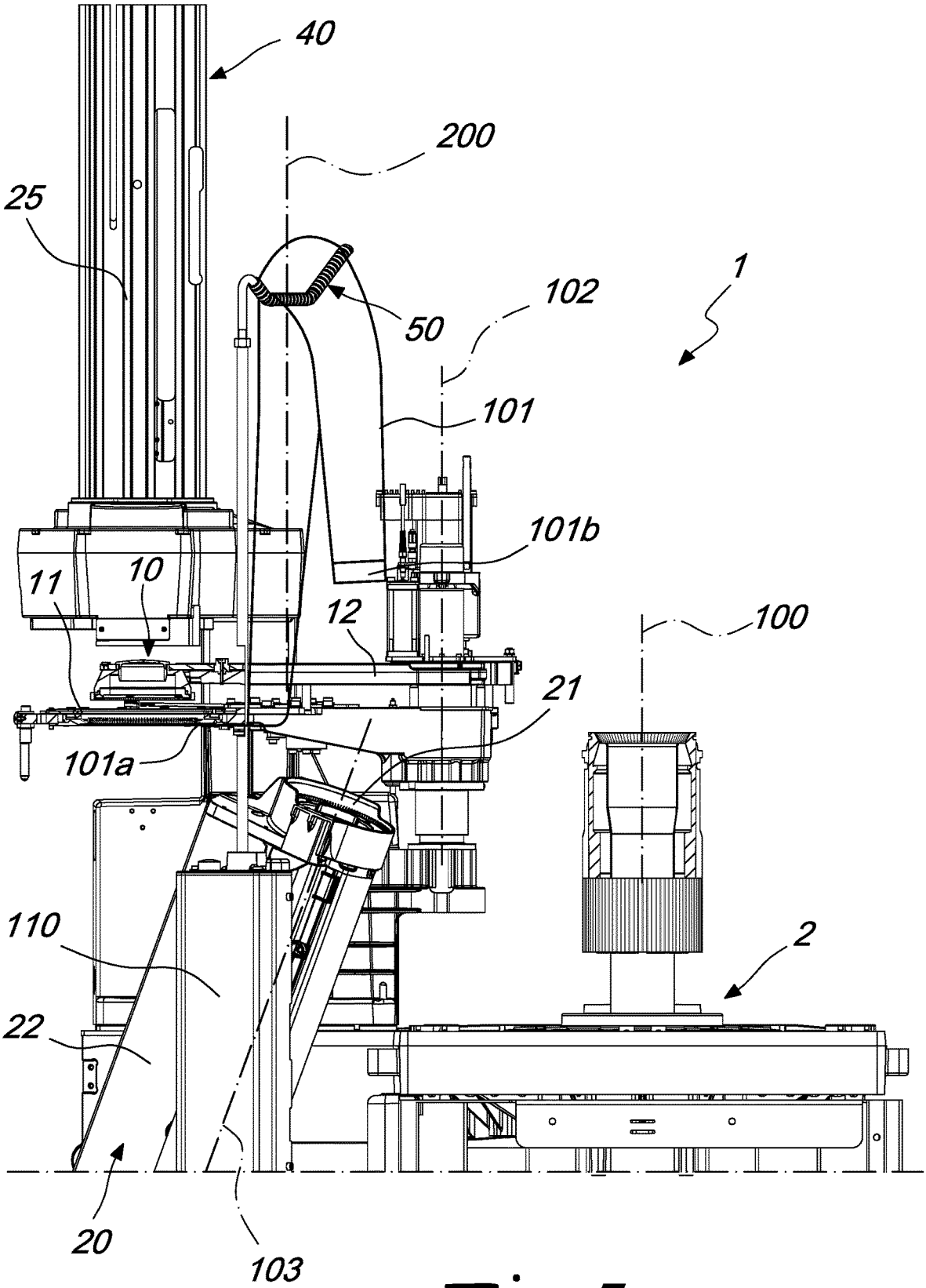
FIG. 7 is a view similar to FIG. 6 after the transition of the lower portion of the turning device from the first position to the second position.
Figure 8:
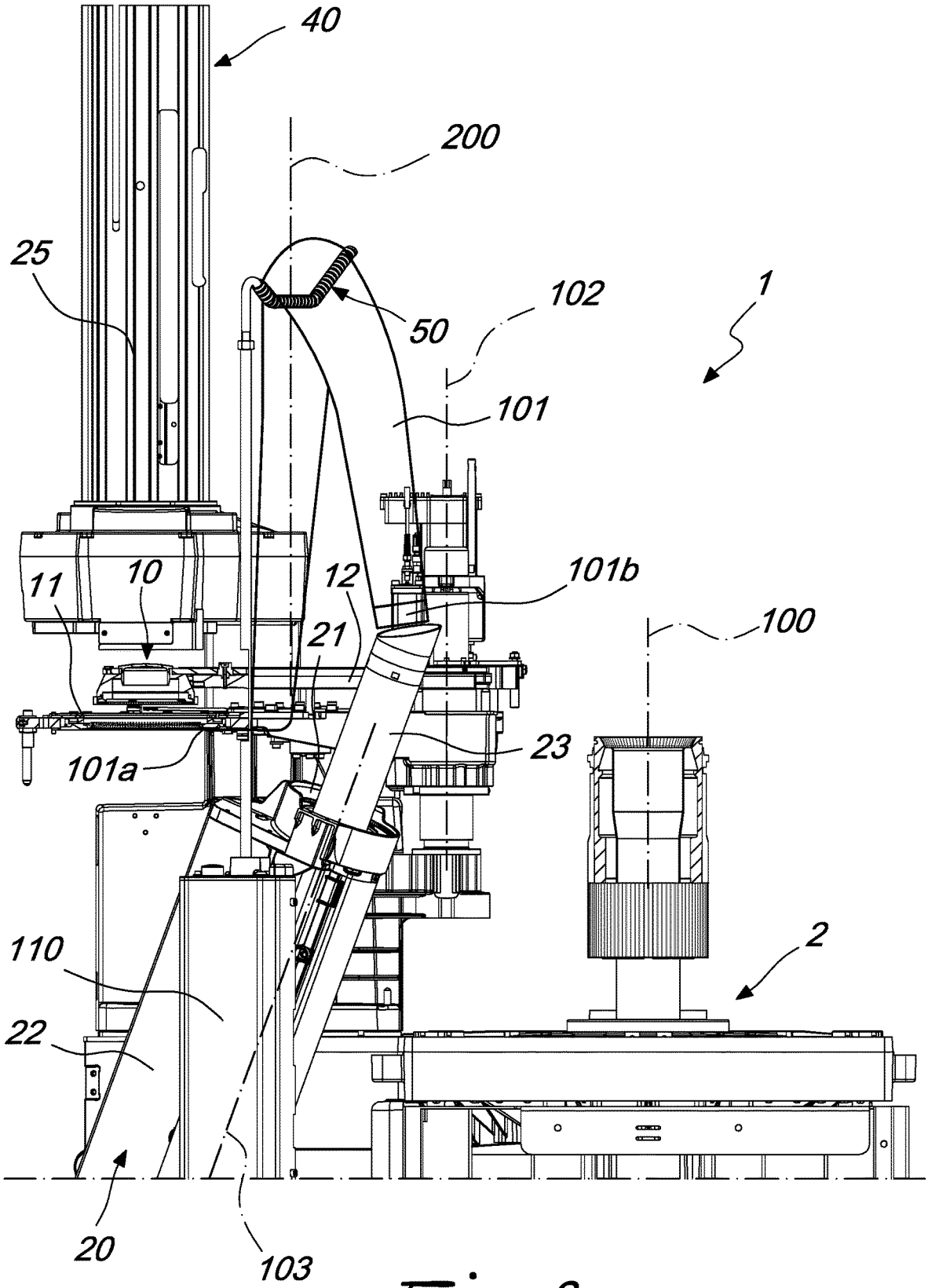
FIG. 8 is a view similar to FIG. 7 with the tubular body in the extended condition.
Figure 9:
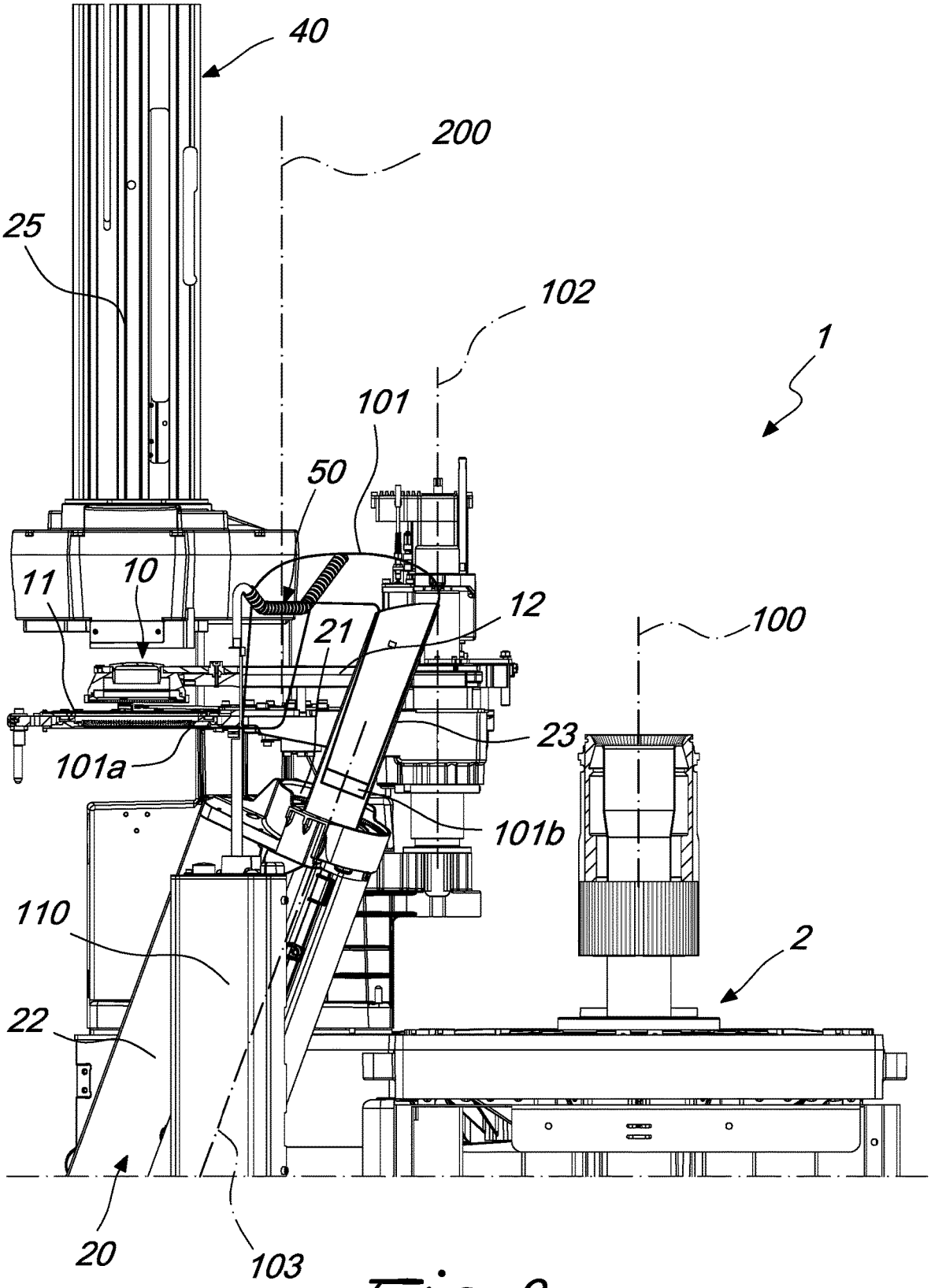
FIG. 9 is a view similar to the previous view in which the lifting element is lowered to a lower level with respect to the situation shown in the previous figure.
Figure 10:
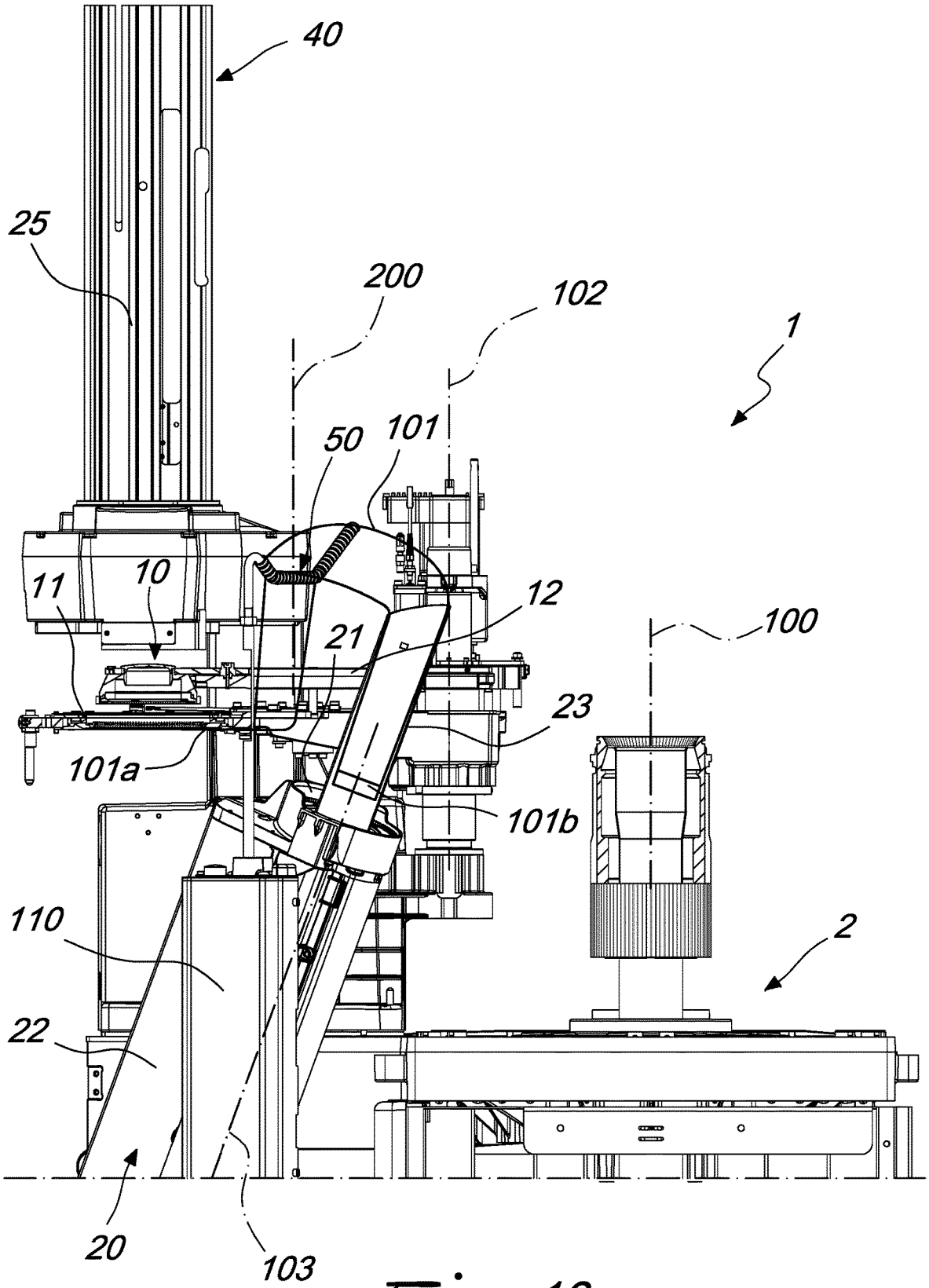
FIG. 10 is a view similar to the previous view with the lifting element lifted further with respect to the situation shown in FIG. 9.
Figure 11:
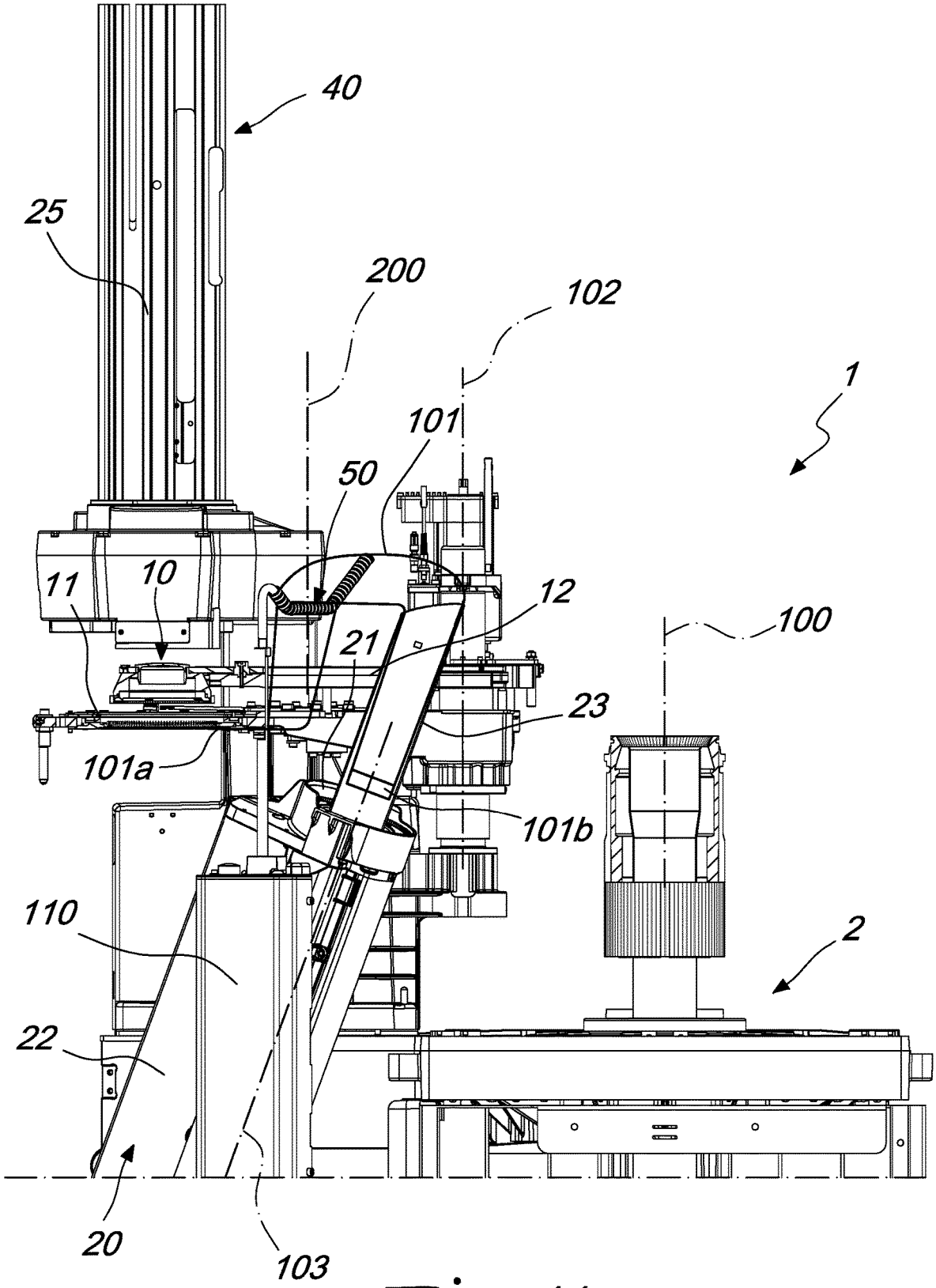
FIG. 11 is a view similar to the previous view in which the lifting element is lowered to a lower level with respect to the situation shown in FIG. 10.
Figure 12:
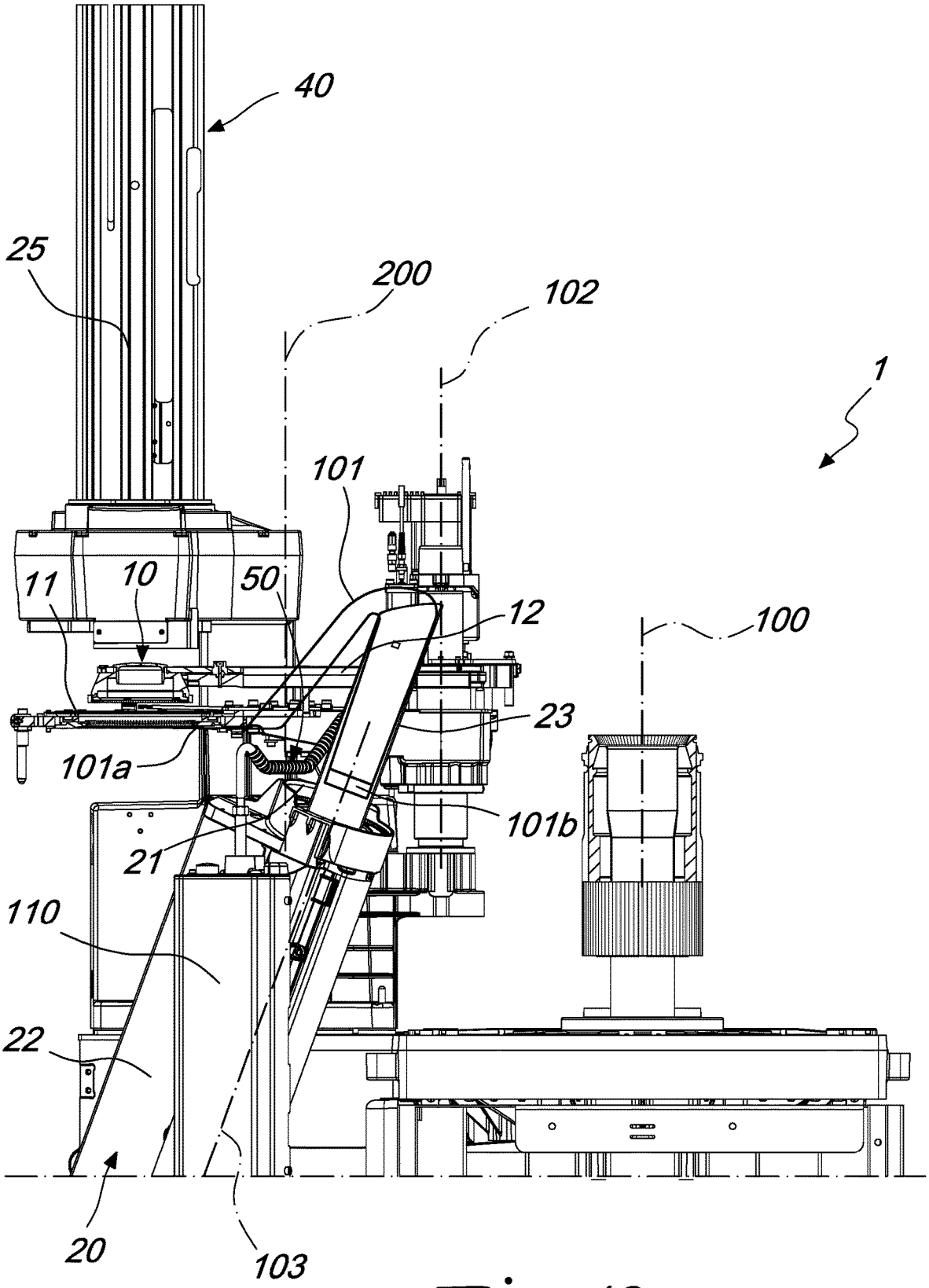
FIG. 12 is a view similar to the previous view in which the lifting element is lowered to a lower level with respect to the situation shown in FIG. 11.
Figure 13:
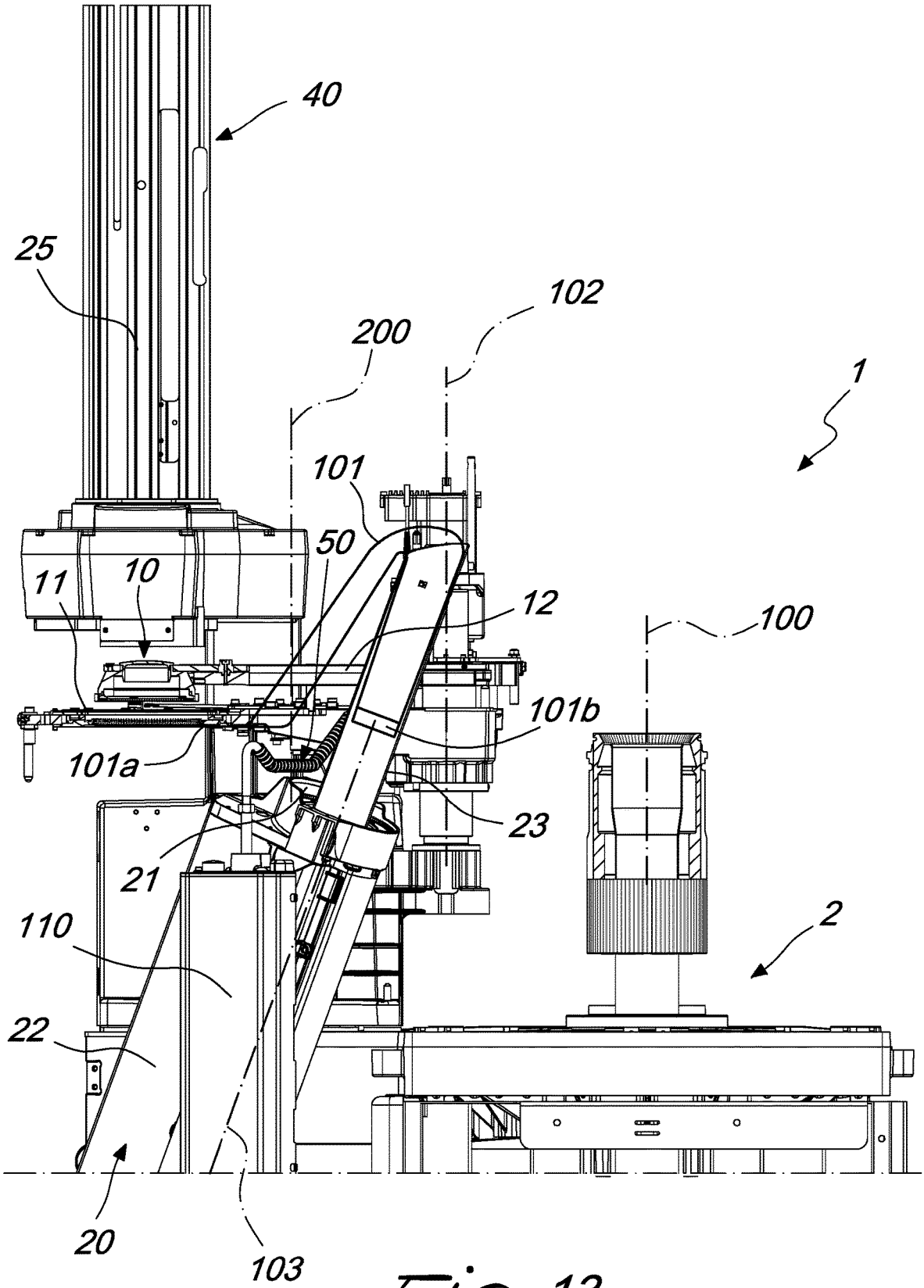
FIG. 13 is a view similar to the previous view in which the tubular body is brought to the fully extended condition.
Figure 14:
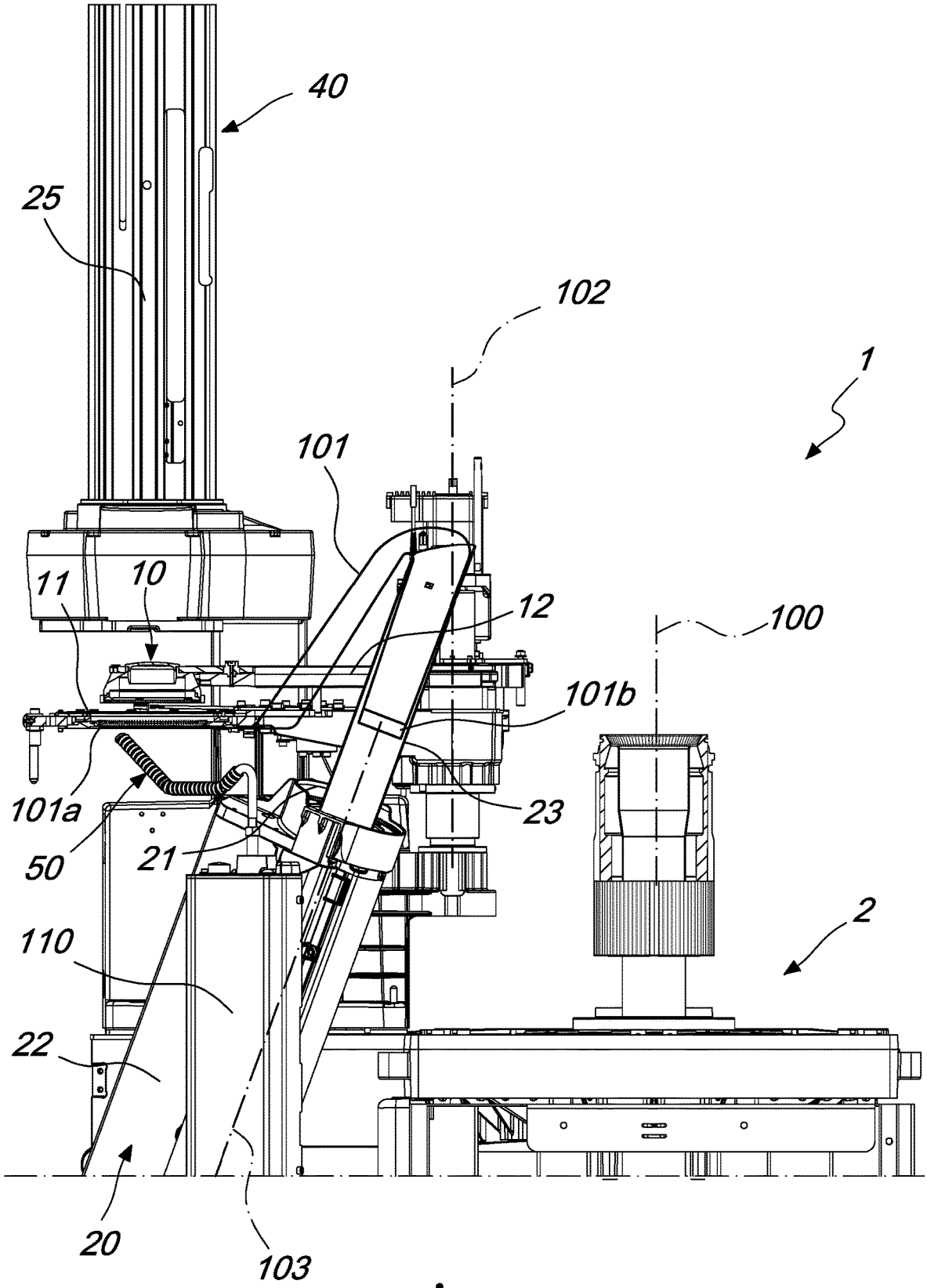
FIG. 14 is a view similar to the previous view in which the lifting element has been returned to the inactive condition.

Then the lower portion 22 of the turning device 20 is moved in order to bring it (as shown in FIG. 7) to the second position so that the access mouth 21 is arranged substantially below the second axial end 101*b* while the lifting element 50 is still in the raised position.

The tubular body 23 accommodated within the lower portion 22 is then brought to the extended, or partially extended, condition (FIG. 8) in order to engage, with its upper opening, with the second axial end 101*b* of the tubular item.

Lowering the lifting element 50 (FIG. 9) helps the insertion of the second axial end 101*b* inside the tubular body 23.

There can therefore be one or more further step(s) of moving (raising and lowering) the lifting element 50 along the direction of lifting 200 (FIGS. 10 and 11) in order to further facilitate the insertion of the tubular item inside the tubular body 23.

At this point the lifting element 50 is brought to the completely lowered position (FIG. 12) and, subsequently, the tubular body 23 is extended further (FIG. 13) so as to bring the tubular item 101, at its full extension, to a higher level than the lifting element 50.

Figure 15:
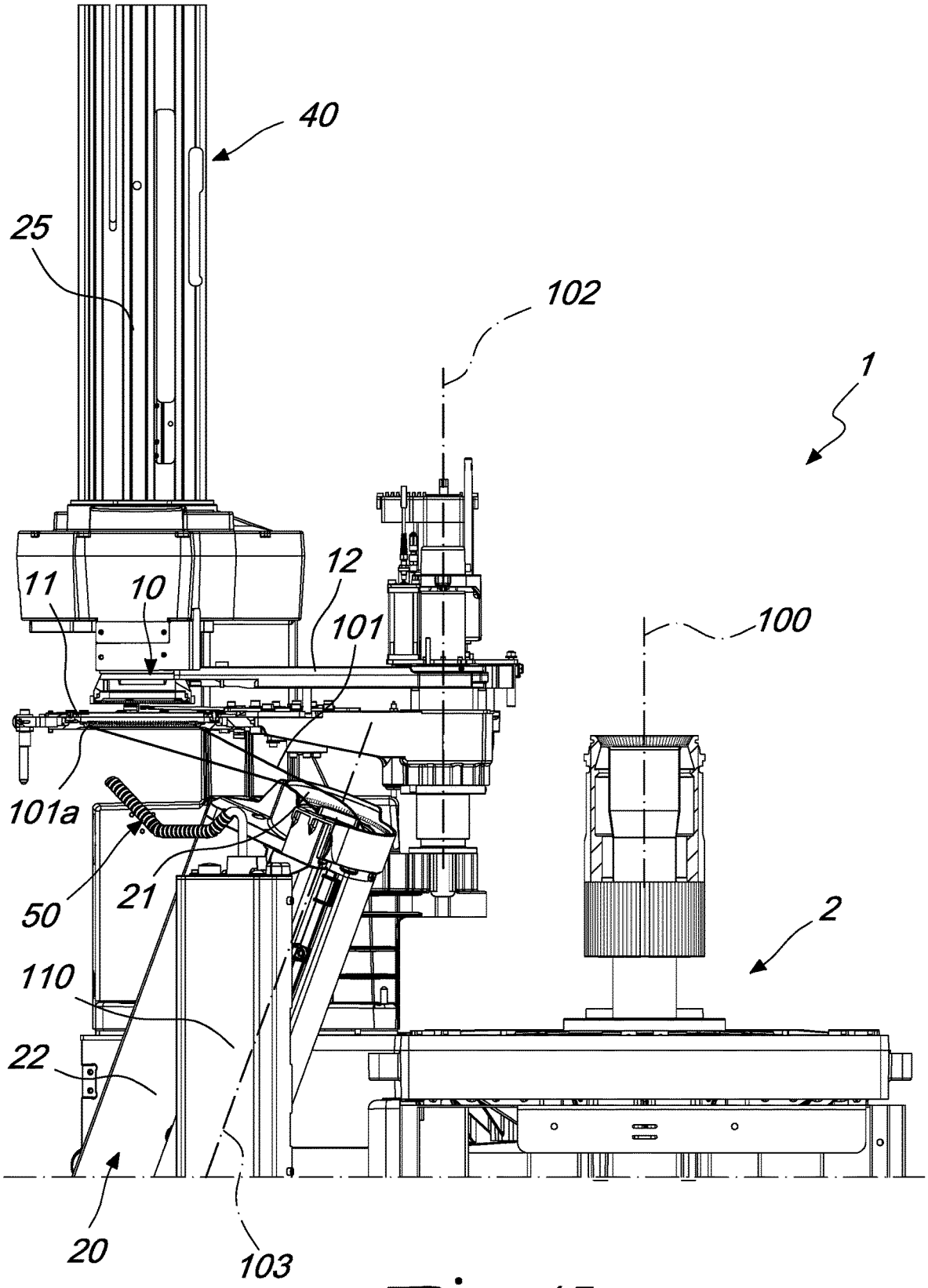
FIG. 15 is a view similar to the previous view in which the tubular body is in the fully retracted condition.
Figure 16:
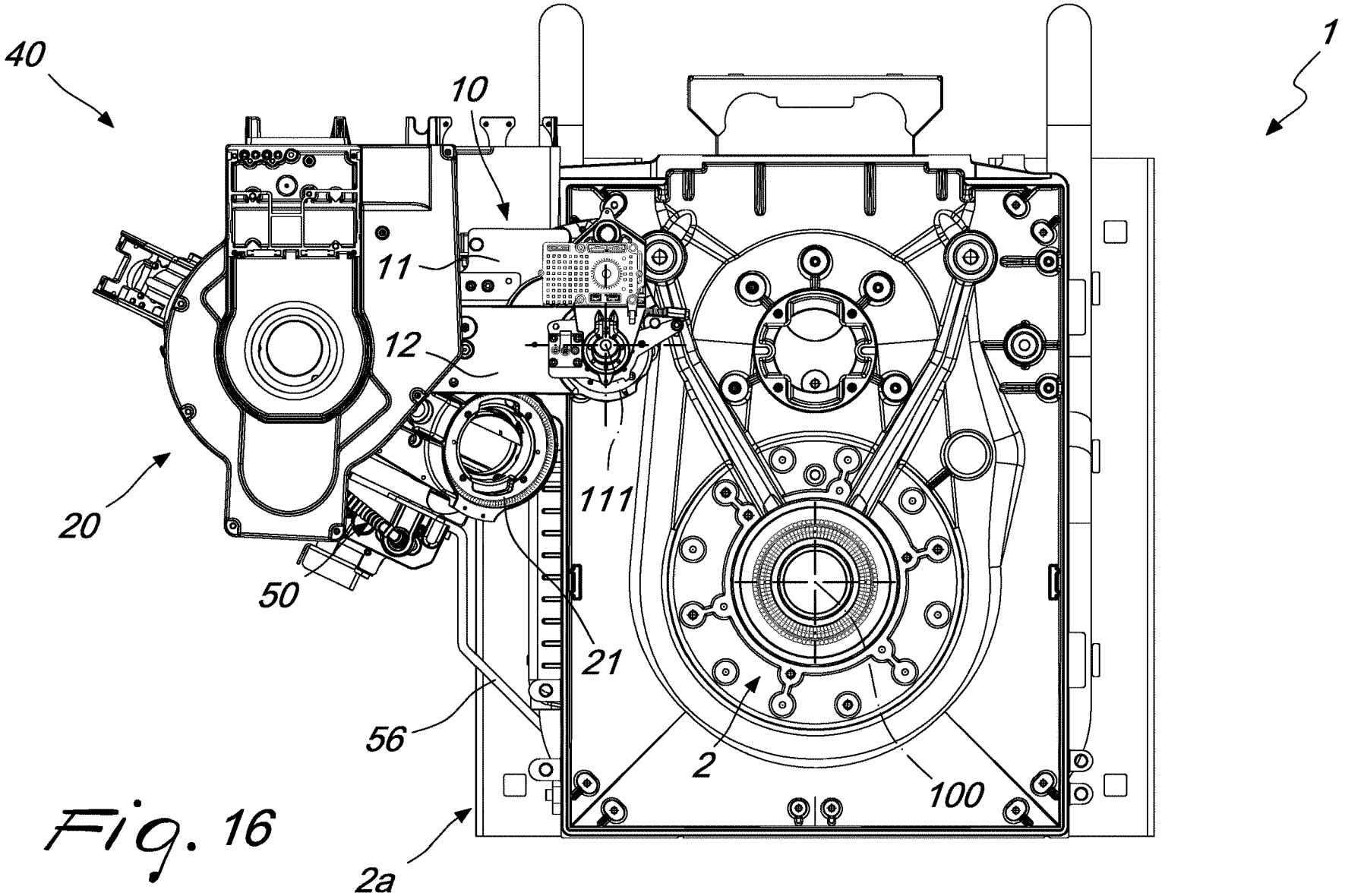
FIG. 16 is a view from above of the machine in the condition of FIG. 15.
Figure 17:
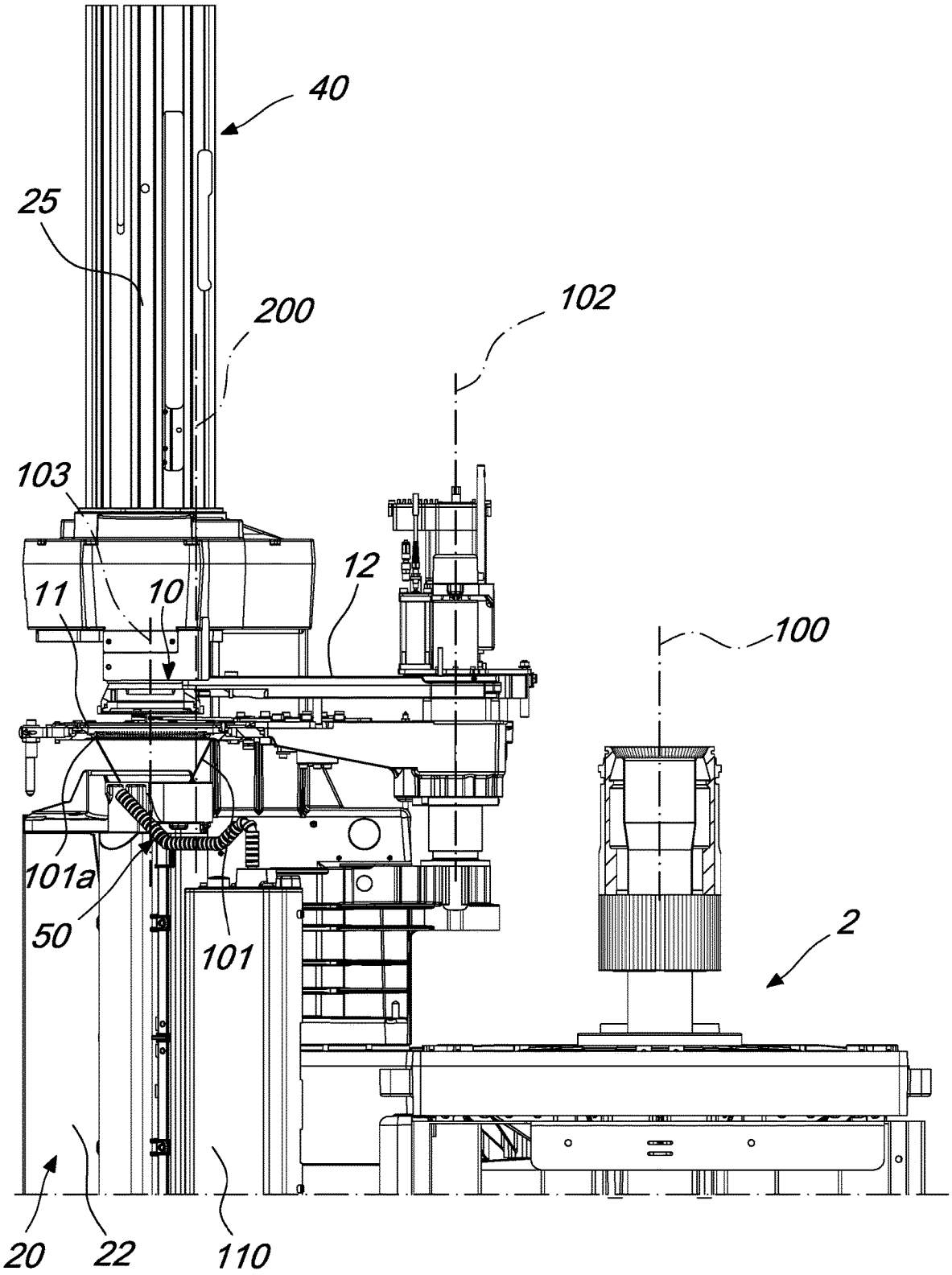
FIG. 17 is a view similar to FIG. 15 in which the lower portion of the turning device is brought to the first position.
Figure 18:
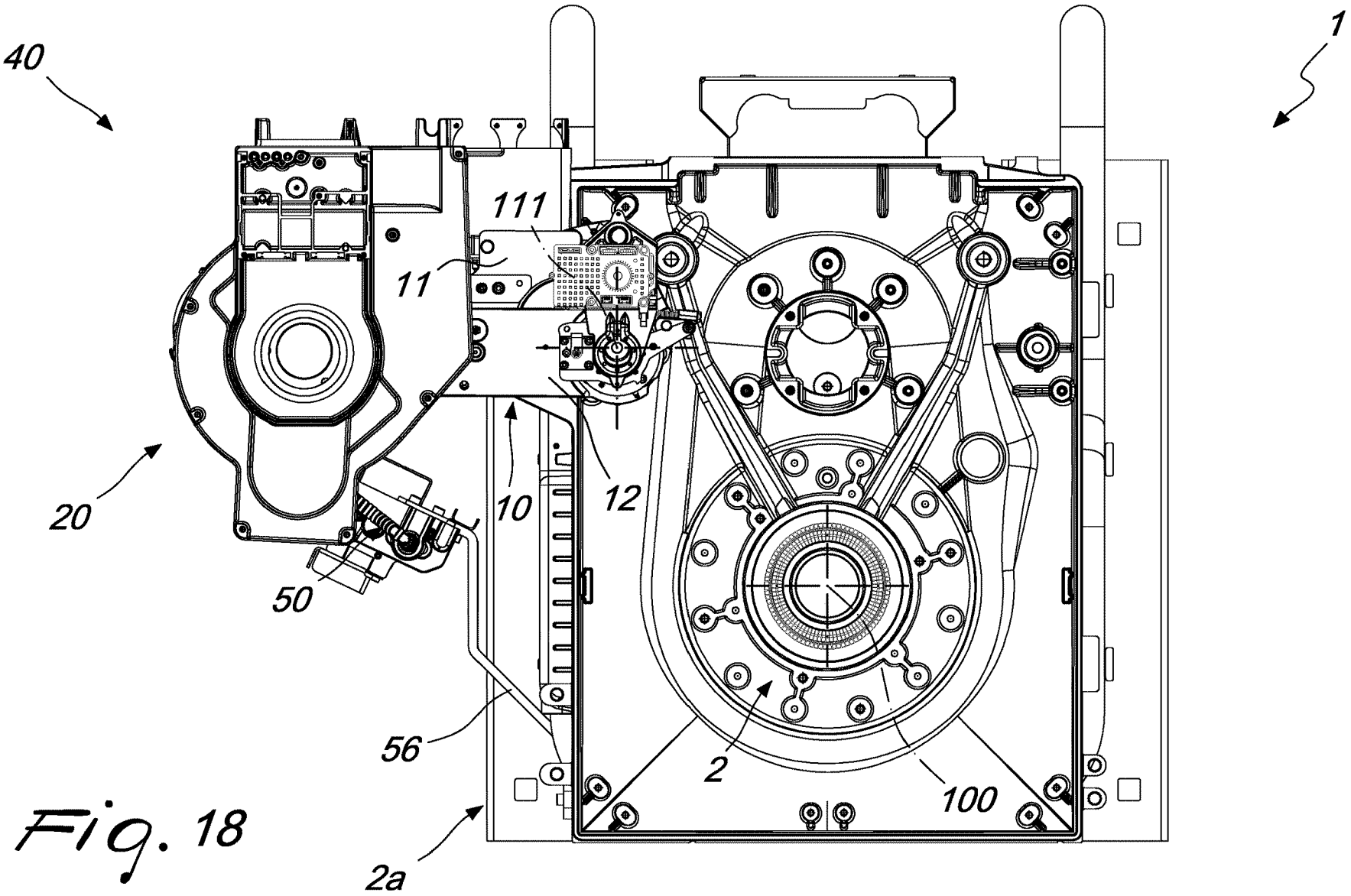
FIG. 18 is a view from above of the machine in the condition of FIG. 17.
Figure 19:
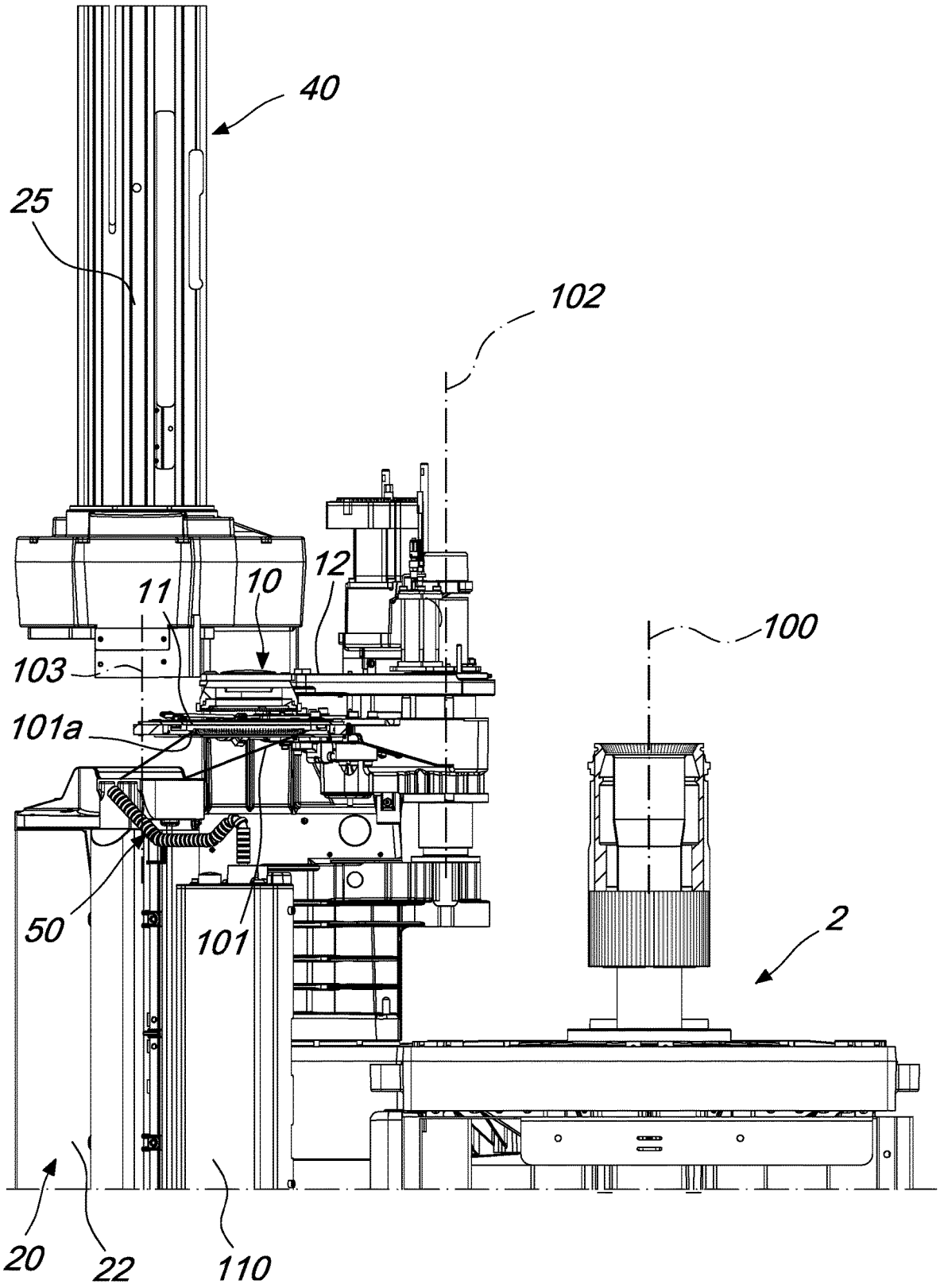
FIG. 19 is a view similar to FIG. 18 in which the pickup device is in an intermediate position between the pickup position and the release position.
Figure 20:
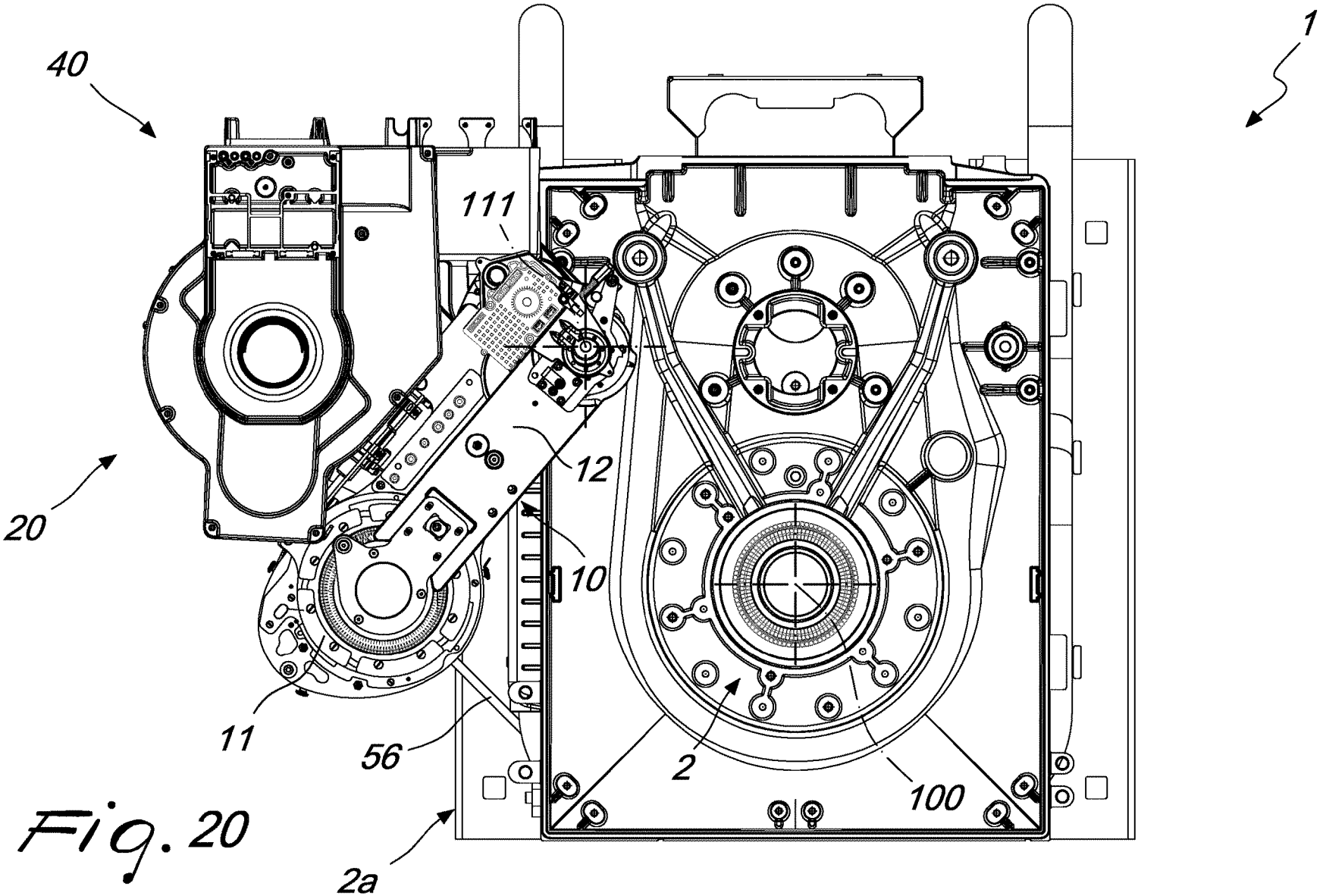
FIG. 20 is a view from above of the machine in the condition of FIG. 19.

The lifting element 50 is then brought back from the active condition to the inactive condition (FIG. 14) so as to be able to proceed to bring the tubular body 23 back to the retracted position (FIG. 15).

Figure 21:
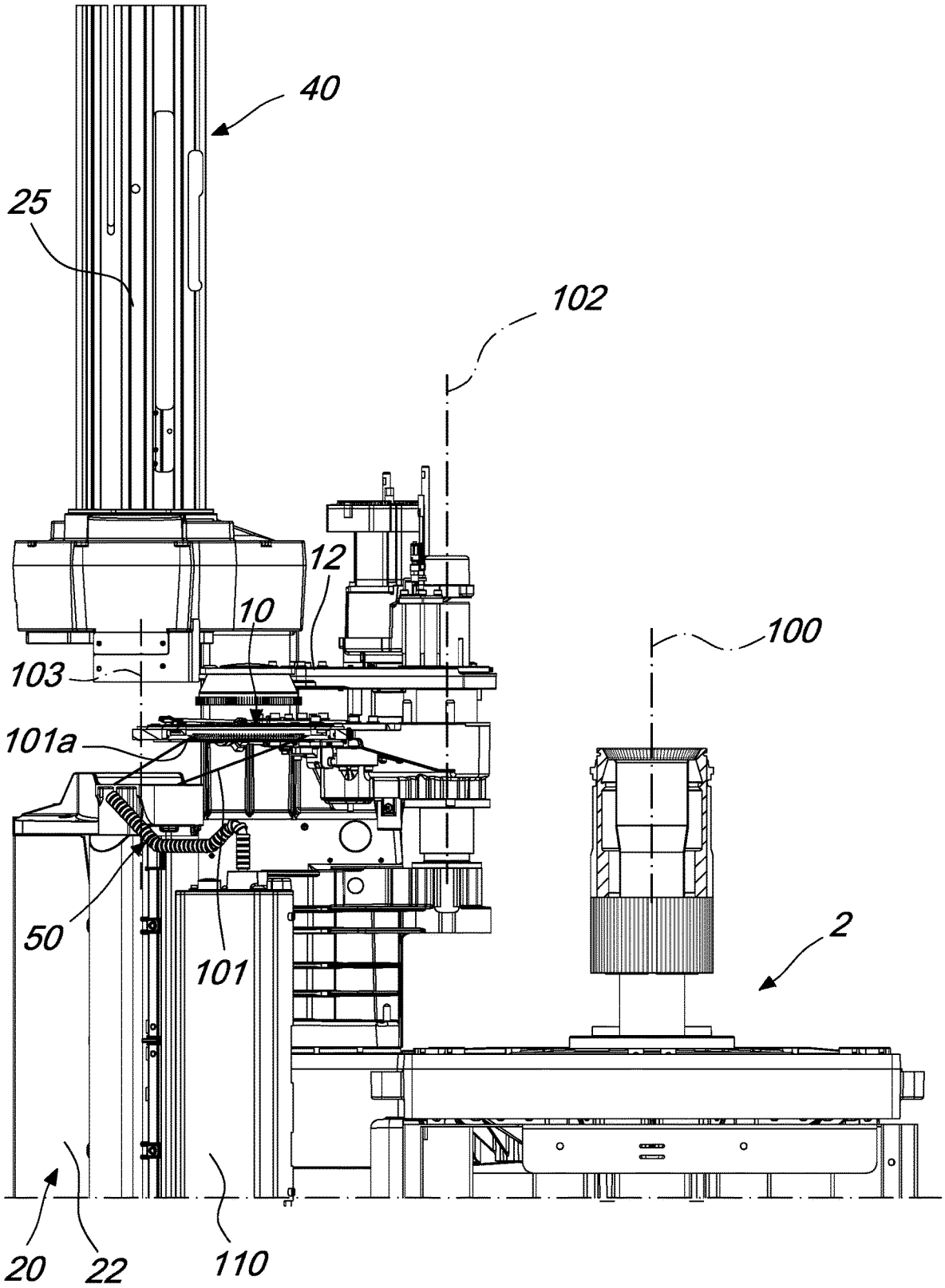
FIG. 21 is a view similar to that of FIG. 19 in which a step is shown in which, with reference to the pickup device, the knitting-pusher arm is moved away from the pickup body.

At this point, the pickup element 10 is brought from the release position (FIG. 17) to an intermediate position (FIG. 19), thus moving the knitting-pusher arm 12 away from the pickup body 11 (FIG. 21).

The pickup body 11 and the corresponding supporting means 41 are brought to the intermediate region, below the upper portion 25 of the pickup device 20 (FIGS. 18, 19 and 20), and then the lower portion 22 is brought back to the first position in which the access mouth 21 is facing the upper portion 25 of the turning device 20 (FIG. 22).

Figure 24:
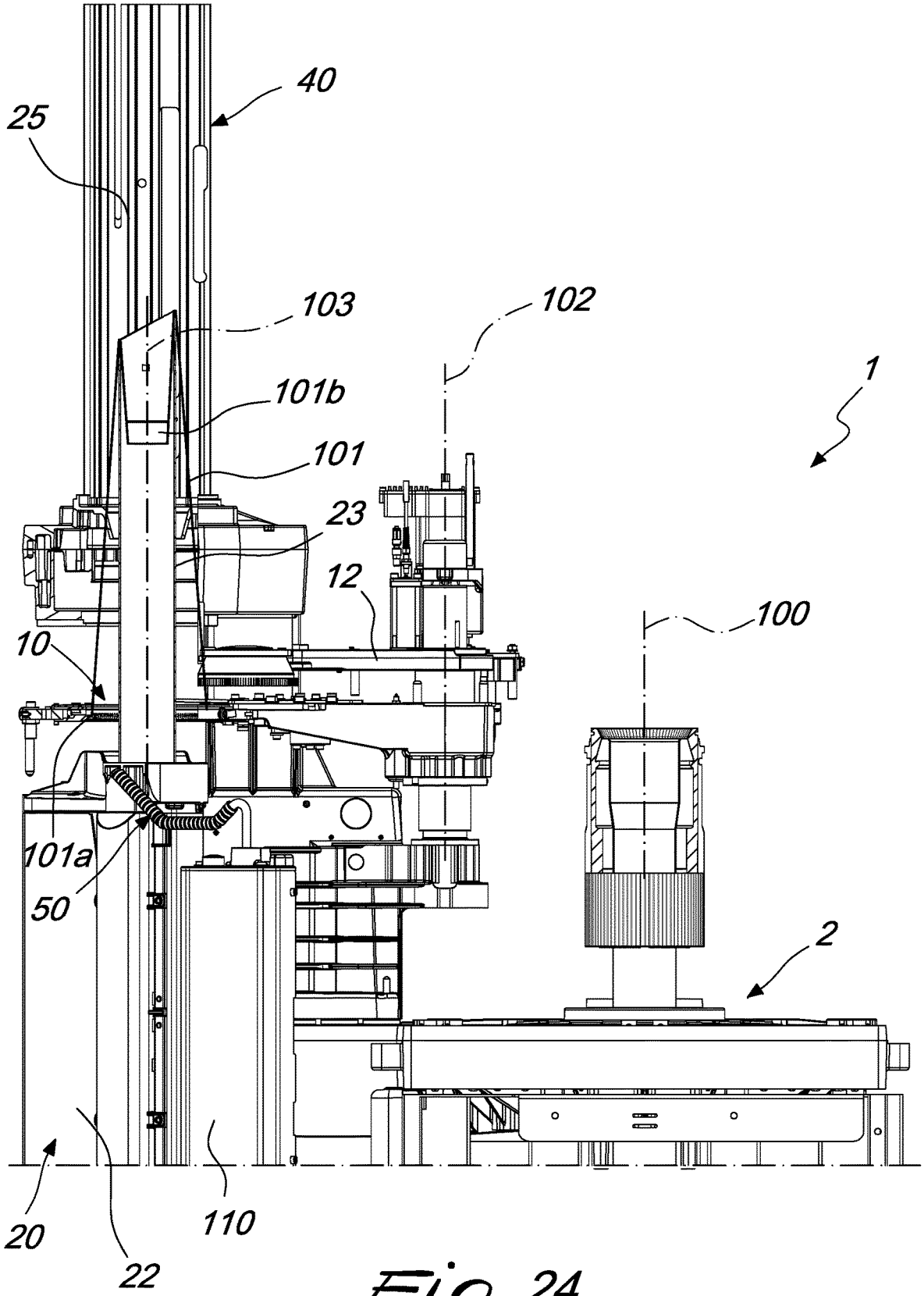
FIG. 24 is a view similar to that of FIG. 22 in which the tubular body is protruding completely in order to perform the eversion and the turning of the tubular item.

Now the tubular body 23 can be brought back to the extended position above the access mouth 21 in order to cause the eversion of the tubular item 101 (FIG. 24).

As pointed out previously, the methods of transferring the tubular item 101 to the turning device 20, and in particular the substeps designed to bring the supporting means 41 to the intermediate region (between the lower portion 22 and the upper portion 25) can be varied and can also entail, for example, moving the knitting-pusher arm 12 away when the pickup body 20) has already been brought to the intermediate region.

In practice it has been found that the invention fully achieves the intended aim and objects by providing a circular machine and a method for providing tubular items that are capable of ensuring an effective conveyance of the tubular item to the turning device, even for extremely heavy tubular items.

The invention thus conceived is susceptible of numerous modifications and variations, all of which are within the scope of the appended claims. Moreover, all the details may be substituted by other, technically equivalent elements.

In practice the materials employed, provided they are compatible with the specific use, and the contingent dimensions and shapes, may be any according to requirements and to the state of the art.

The invention claimed is:

1. A method for providing a tubular item, comprising the sequential steps of:

producing, using at least one needle cylinder, a tubular item having a first axial end and a second axial end;

picking up, using a pickup device, said tubular item at said first axial end;

transferring said first axial end of the tubular item from a pickup position, at said at least one needle cylinder, to a release position at a further processing station of said tubular item;

moving a lifting element from an inactive position, in which it is arranged externally with respect to a region affected by a movement of said pickup device and of the tubular item associated therewith during a transition of a lower portion of said a turning device from a second position to a first position, to an active position, in which said lifting element is adapted to interact with at least one portion of said tubular item;

a first lifting of said lifting element to said active position along a lifting trajectory in order to engage with a portion of said tubular item so as to determine a disengagement of the second axial end of said tubular item, opposite to said first axial end, from said at least one needle cylinder;

moving the lower portion of said turning device which has an access mouth between the first position, in which said access mouth is aligned with an upper portion of said turning device to allow a turning of said tubular item, and the second position, in which said access mouth is arranged laterally with respect to said upper portion and substantially below said second axial end of said tubular item in order to allow the transfer of said tubular item from said at least one needle cylinder into said lower portion of said turning device wherein said lower portion of said turning device is inclined about a pivoting axis in order to pass from said first position to said second position;

aspirating said tubular item in order to retain and transfer the tubular item, through said access mouth, to said lower portion of said turning device;

moving said lifting element from said active position to said inactive position;

moving said lower portion of said turning device from said second position to said first position.

2. The method according to claim 1, further comprising, after said step of moving said lower portion from said second position to said first position, a step of turning said tubular item using said turning device.

3. The method according to claim 2, further comprising, between said step of moving said lower portion between said first position and said second position and said step of aspirating, a second lifting of said lifting element along said lifting trajectory.

* * * * *